US011471023B2

(12) United States Patent
Choi et al.

(10) Patent No.: US 11,471,023 B2
(45) Date of Patent: Oct. 18, 2022

(54) FRONT AND TOP LOADING DISHWASHER WITH RESTRICTED BASKET MOVEMENT

(71) Applicant: SAMSUNG ELECTRONICS CO., LTD., Suwon-si (KR)

(72) Inventors: Sang Soo Choi, Suwon-si (KR); Sung Jin Kim, Suwon-si (KR); Chang Wook Lee, Seoul (KR); Seung Gee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 214 days.

(21) Appl. No.: 16/643,688

(22) PCT Filed: May 24, 2018

(86) PCT No.: PCT/KR2018/005890
§ 371 (c)(1),
(2) Date: Mar. 2, 2020

(87) PCT Pub. No.: WO2019/045230
PCT Pub. Date: Mar. 7, 2019

(65) Prior Publication Data

US 2021/0153714 A1 May 27, 2021

(30) Foreign Application Priority Data

Aug. 31, 2017 (KR) ..... 10-2017-0111442
Aug. 31, 2017 (KR) ..... 10-2017-0111458

(51) Int. Cl.
*A47L 15/42* (2006.01)
*A47L 15/44* (2006.01)
(Continued)

(52) U.S. Cl.
CPC ..... *A47L 15/4263* (2013.01); *A47L 15/0086* (2013.01); *A47L 15/44* (2013.01); *A47L 15/501* (2013.01)

(58) Field of Classification Search
None
See application file for complete search history.

(56) References Cited

U.S. PATENT DOCUMENTS 3,092,134 A * 6/1963 Allen ..... A47L 15/4251 134/186
3,727,622 A * 4/1973 Jacobs ..... A47L 15/502 134/183
(Continued)

FOREIGN PATENT DOCUMENTS

FR 2004067 11/1969
FR 2004067 A1 * 11/1969 ..... A47L 15/4257
(Continued)

OTHER PUBLICATIONS

International Search Report dated Sep. 19, 2018 from International Patent Application No. PCT/KR2018/005890, 4 pages.
(Continued)

*Primary Examiner* — Michael E Barr
*Assistant Examiner* — Omair Chaudhri
(74) *Attorney, Agent, or Firm* — Staas & Halsey LLP

(57) ABSTRACT

Provided is a dishwasher with a structure capable of improving ease of use. The dishwasher may be installed in a built-in type in a system kitchen including a cabinet having an accommodating space and a counter positioned on the cabinet and including an opening. The dishwasher may include: a tub including a front opening; a front door configured to open or close the front opening; a top door configured to open or close the opening; a basket positioned in the inside of the tub, the basket being taken out through
(Continued)

the front opening; and an additional basket being taken out through the opening.

6 Claims, 36 Drawing Sheets

(51) Int. Cl.
*A47L 15/50* (2006.01)
*A47L 15/00* (2006.01)

(56) References Cited

U.S. PATENT DOCUMENTS

| | | | | |
|---|---|---|---|---|
| 2002/0139809 | A1* | 10/2002 | Barry | A47L 15/502 220/762 |
| 2003/0205255 | A1* | 11/2003 | DeBoer | A47L 15/4209 134/115 R |
| 2005/0098197 | A1* | 5/2005 | DeHart | A47B 37/00 134/201 |
| 2009/0120883 | A1* | 5/2009 | Jadhav | A47L 15/503 211/41.9 |
| 2013/0002107 | A1* | 1/2013 | Paschini | A47L 15/502 312/228.1 |
| 2017/0224189 | A1* | 8/2017 | Kulkarni | A47L 15/22 |
| 2018/0125330 | A1* | 5/2018 | Naik | A47L 15/506 |

FOREIGN PATENT DOCUMENTS

| | | | | |
|---|---|---|---|---|
| JP | H11197083 | A | * | 1/1998 |
| JP | H1028667 | A | * | 2/1998 |
| JP | H10179286 | A | * | 7/1998 |
| JP | 11-178661 | A | | 7/1999 |
| JP | 11178661 | A | * | 7/1999 |
| JP | 2000037337 | A | * | 2/2000 |
| JP | 2000051133 | A | * | 2/2000 |
| JP | 2001-377 | | | 1/2001 |
| JP | 2004-329249 | | | 11/2004 |
| KR | 10-0271711 | B1 | | 8/2000 |
| KR | 20-2011-0006400 | | | 6/2011 |
| KR | 20-2011-0006400 | U | | 6/2011 |
| KR | 20110006400 | U | * | 6/2011 |
| KR | 10-2016-0020334 | A | | 2/2016 |
| KR | 10-1643740 | B1 | | 7/2016 |
| WO | WO-2019196954 | A1 | * | 10/2019 |

OTHER PUBLICATIONS

Extended European Search Report dated Mar. 17, 2020 from European Application No. 18850474.0, 6 pages.
European Office Action dated Aug. 5, 2021 from European Patent Application No. 18 850 474.0, 3 pages.

* cited by examiner

【FIG. 1】
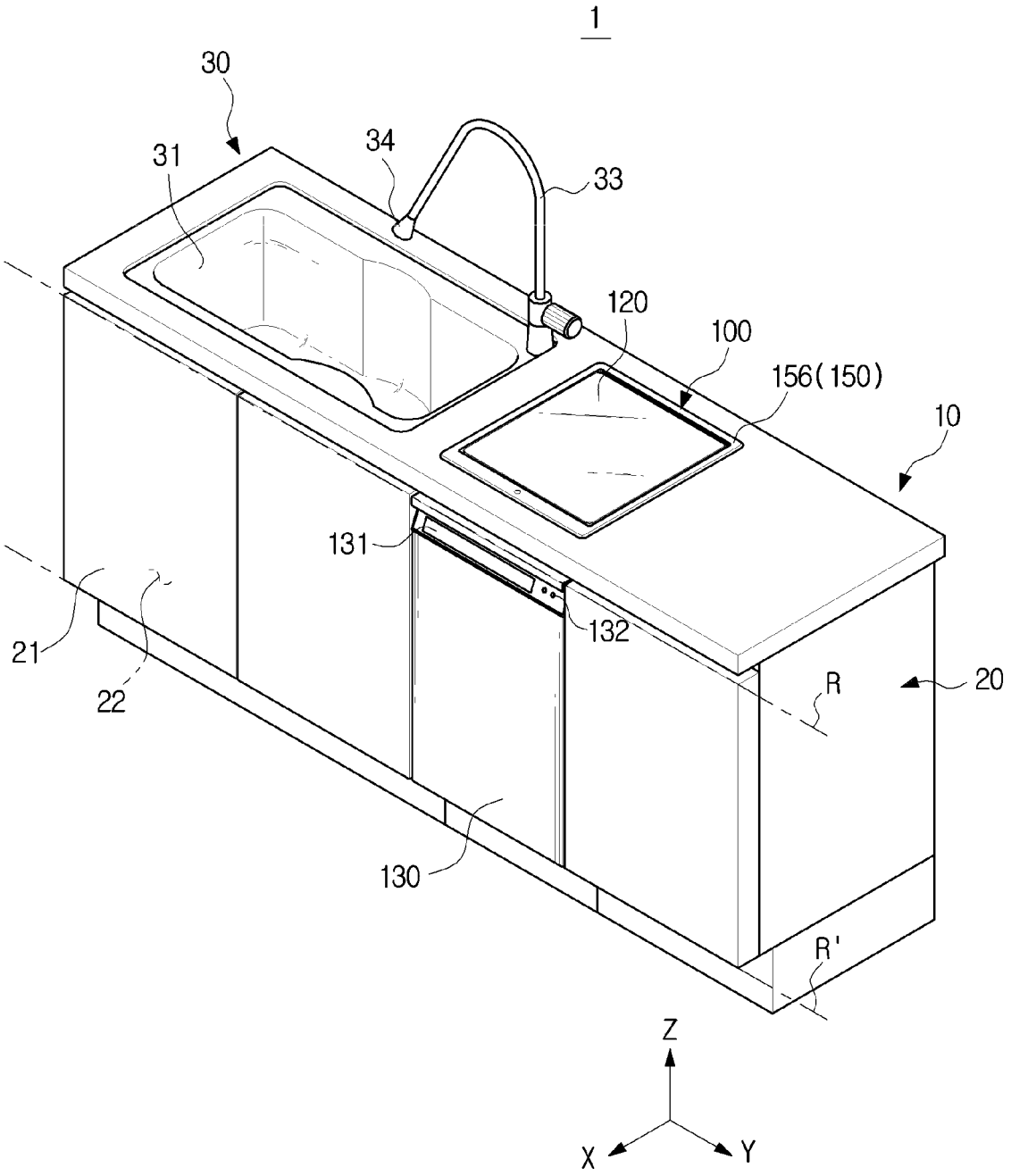

【FIG. 2】
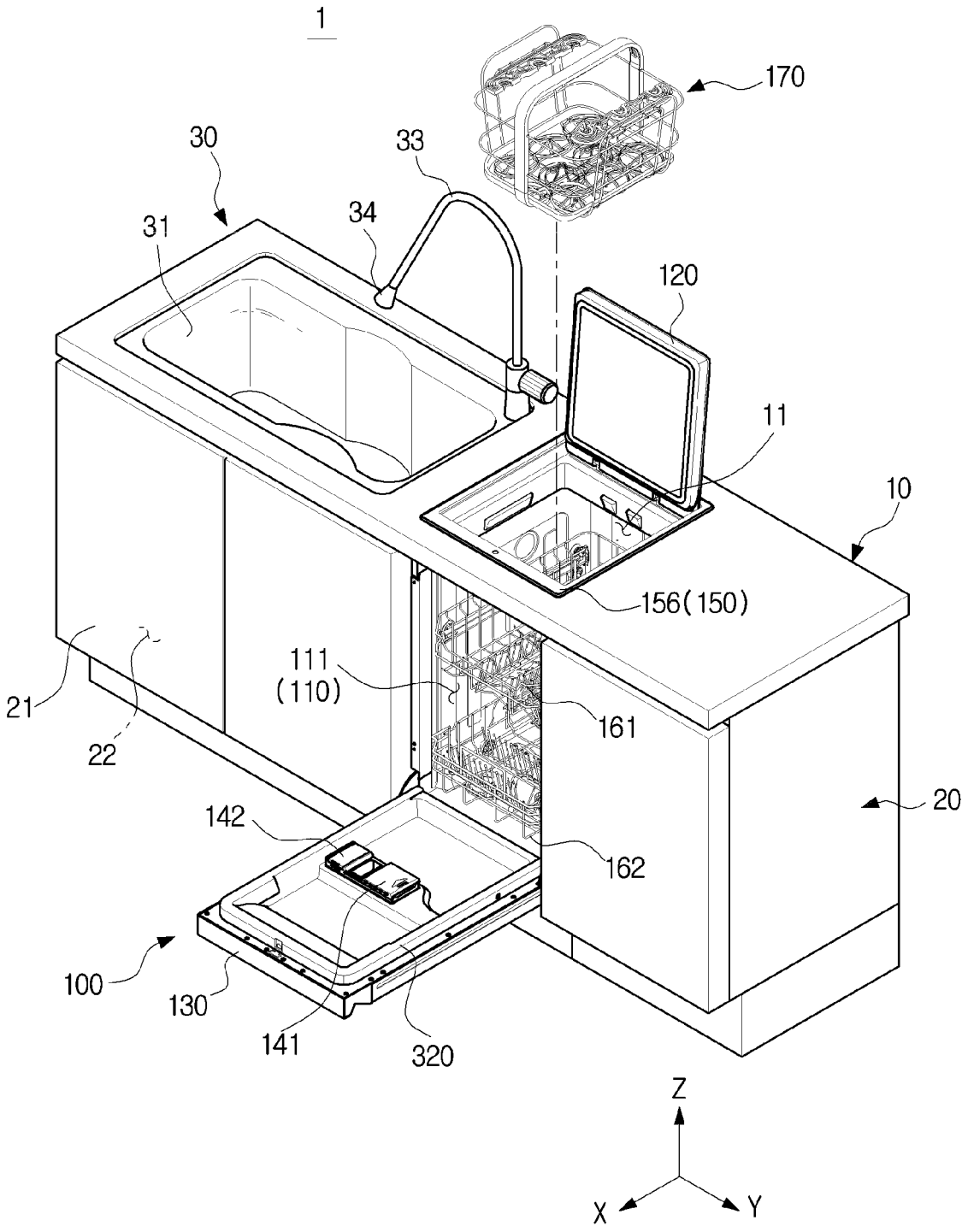

【FIG. 3】
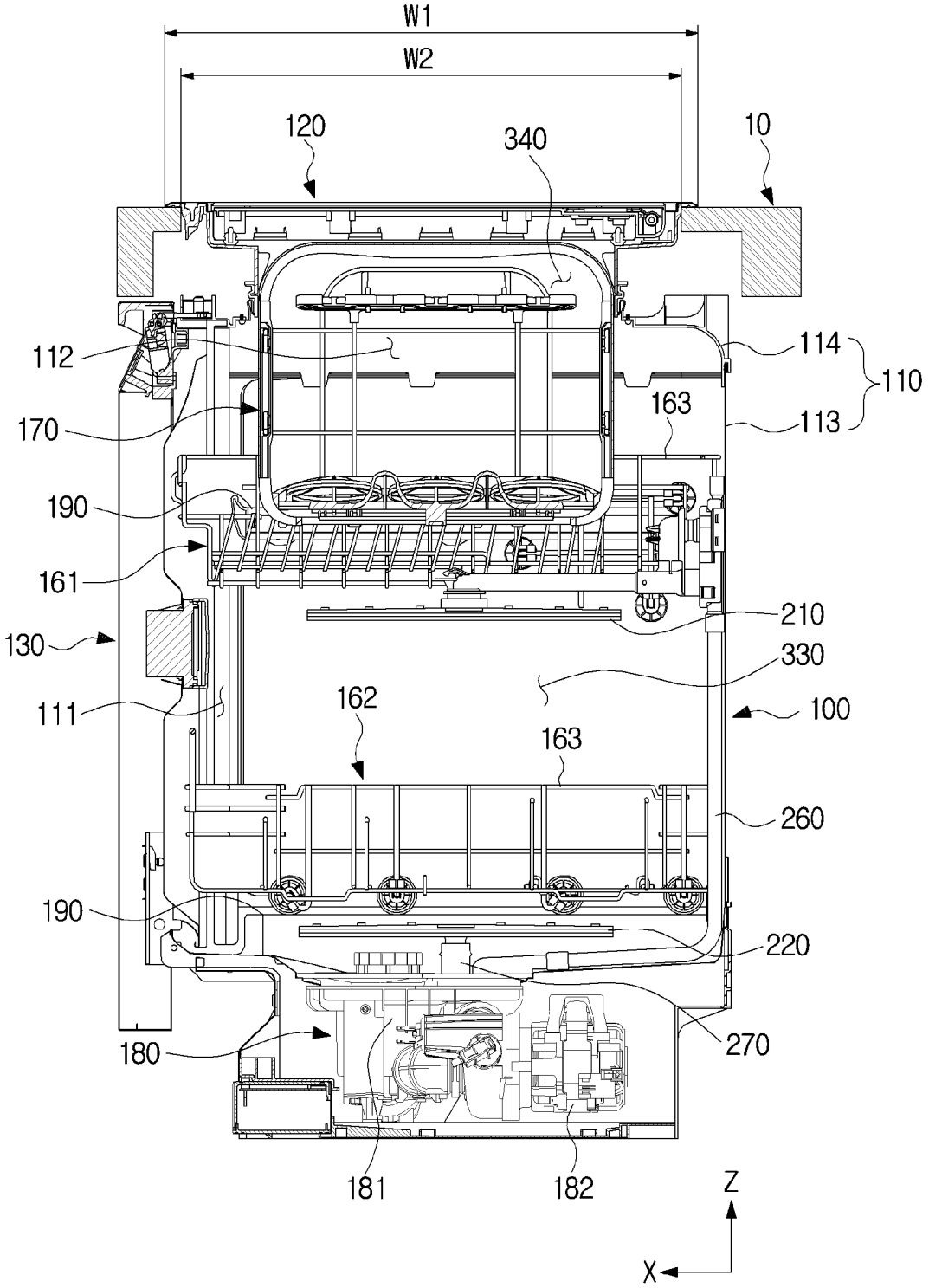

【FIG. 4】
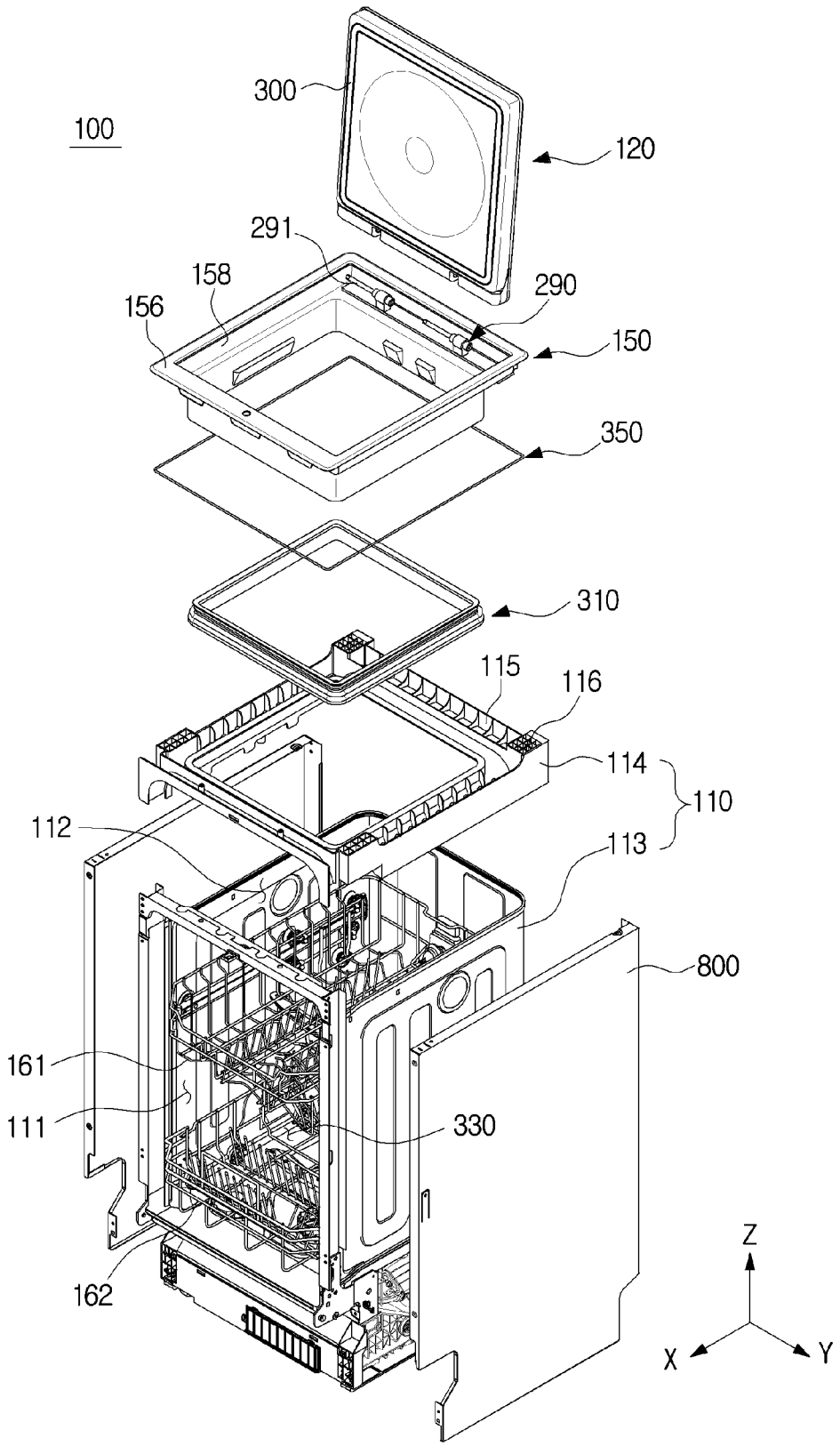

【FIG. 5】
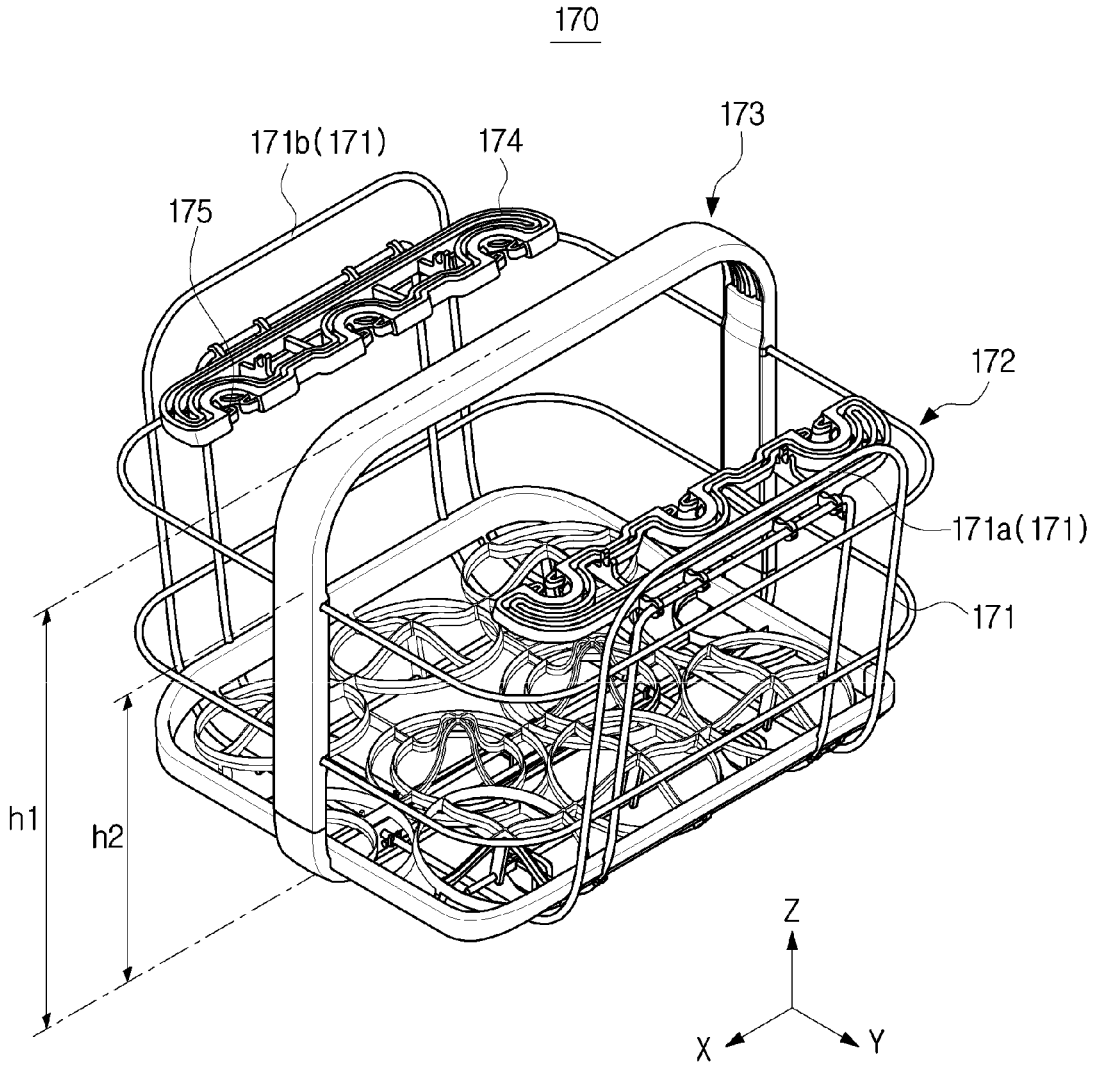

【FIG. 6】
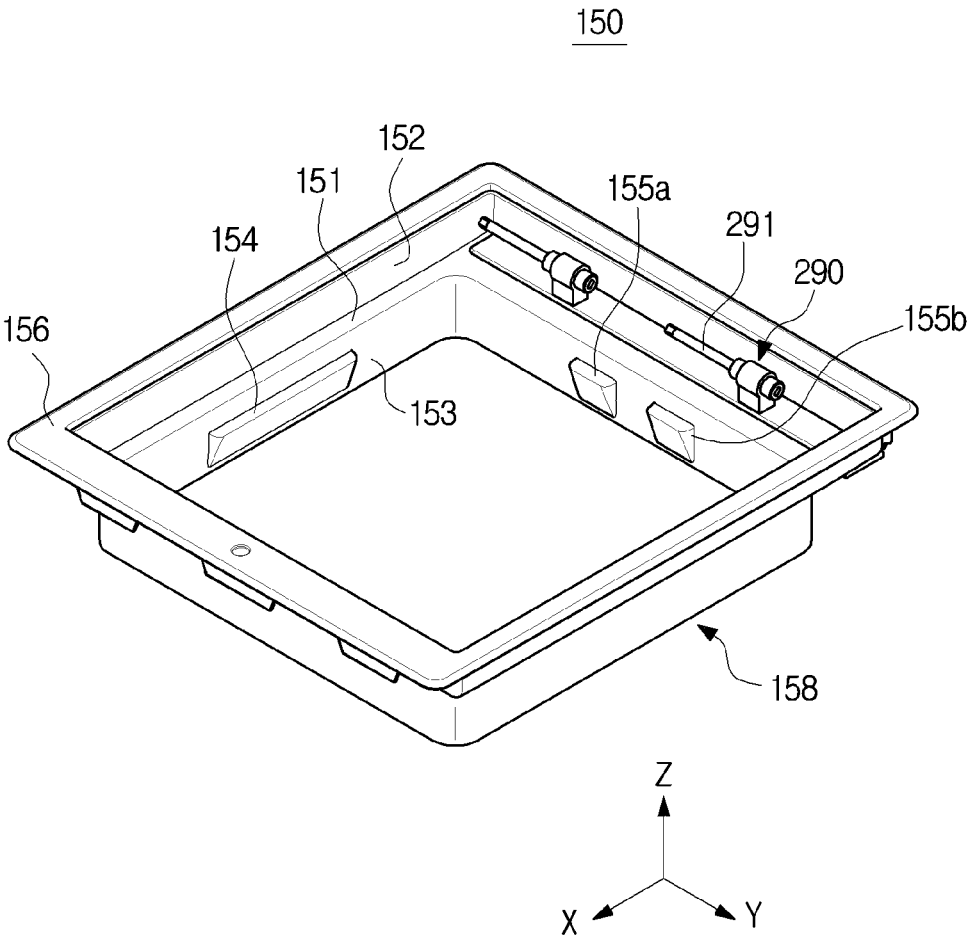

【FIG. 7】
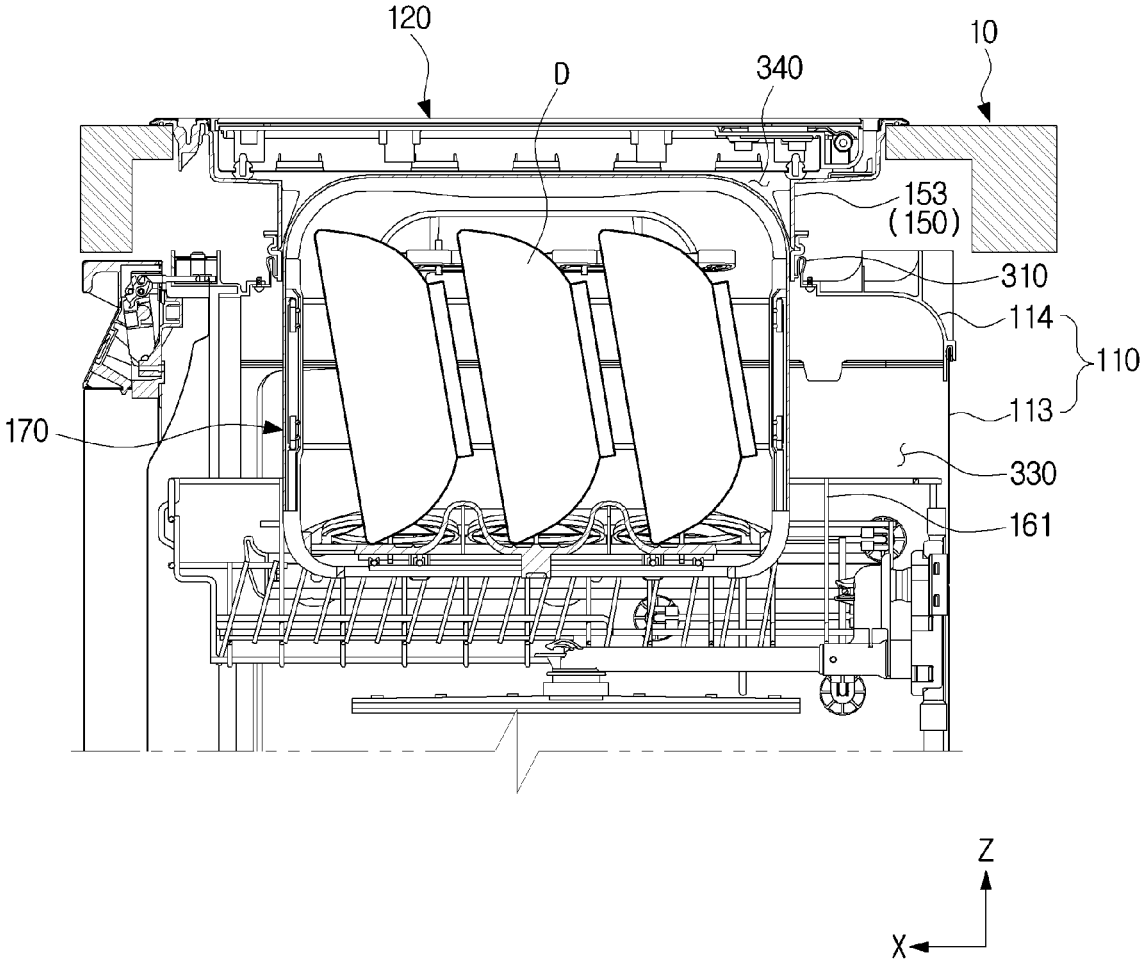

【FIG. 8A】
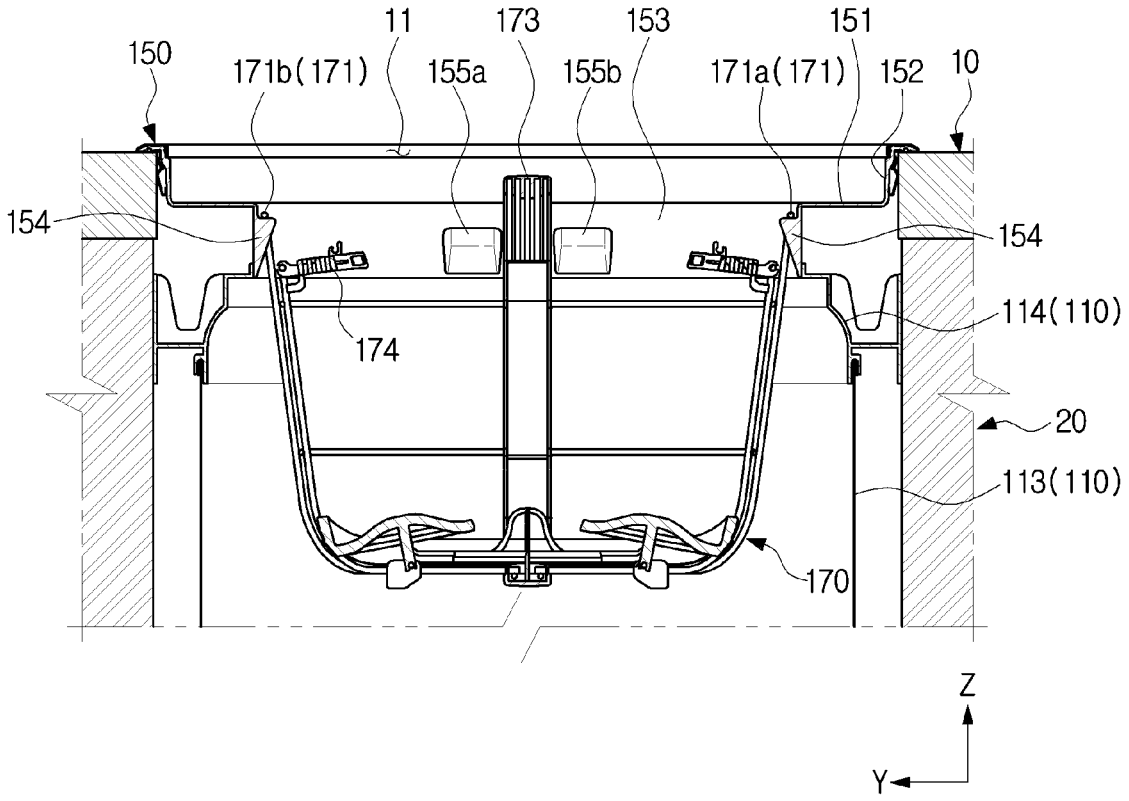

【FIG. 8B】
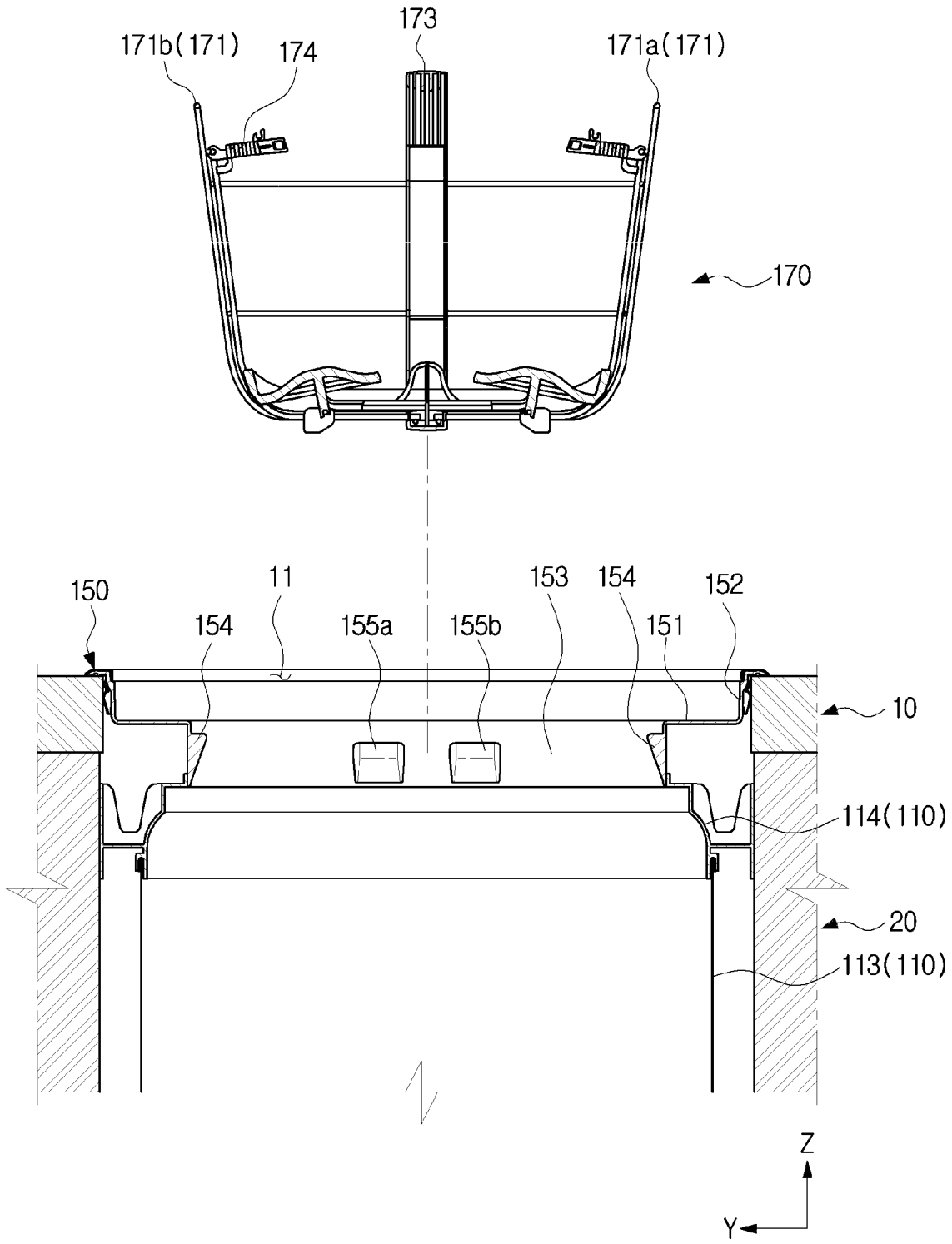

【FIG. 9A】
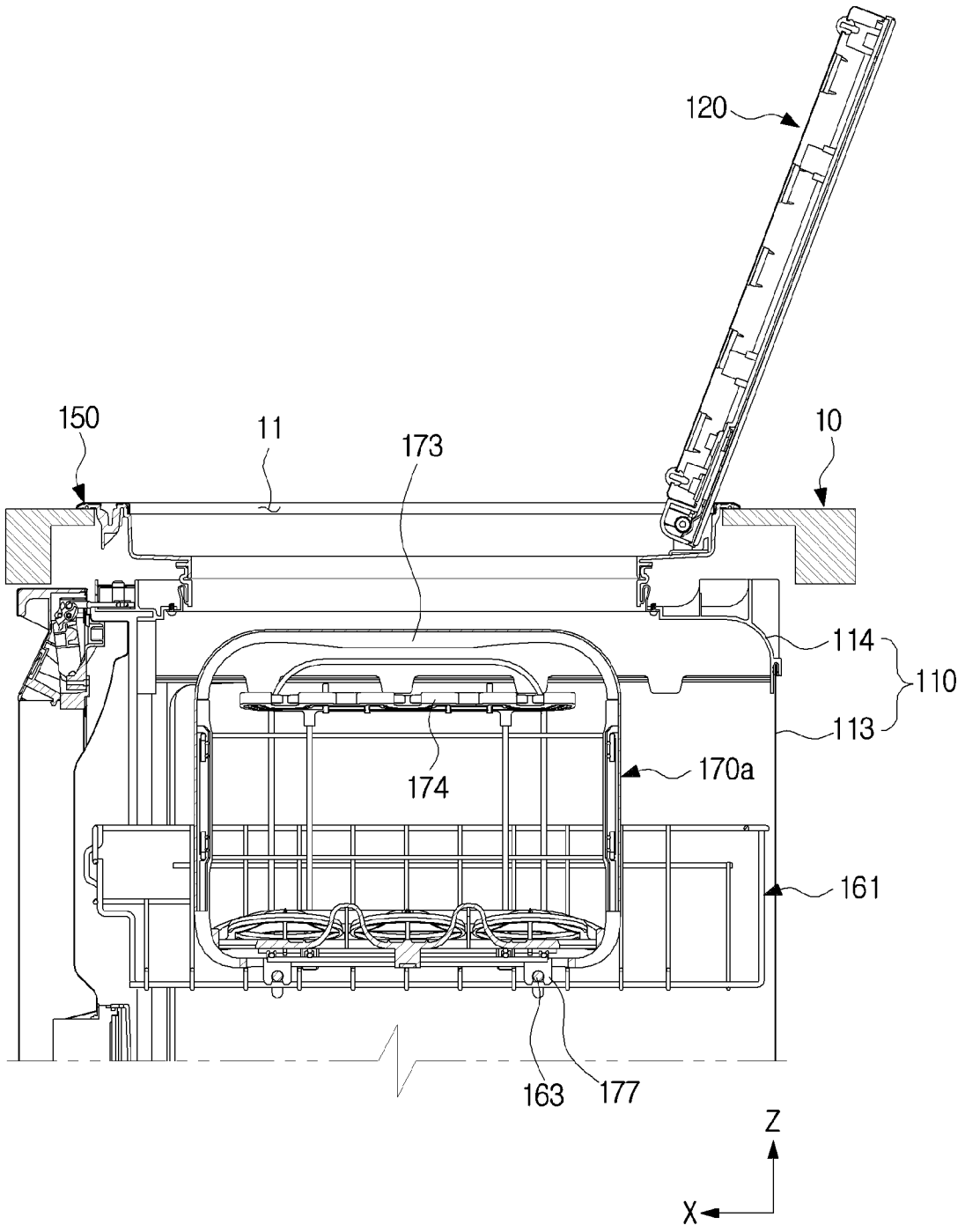

【FIG. 9B】
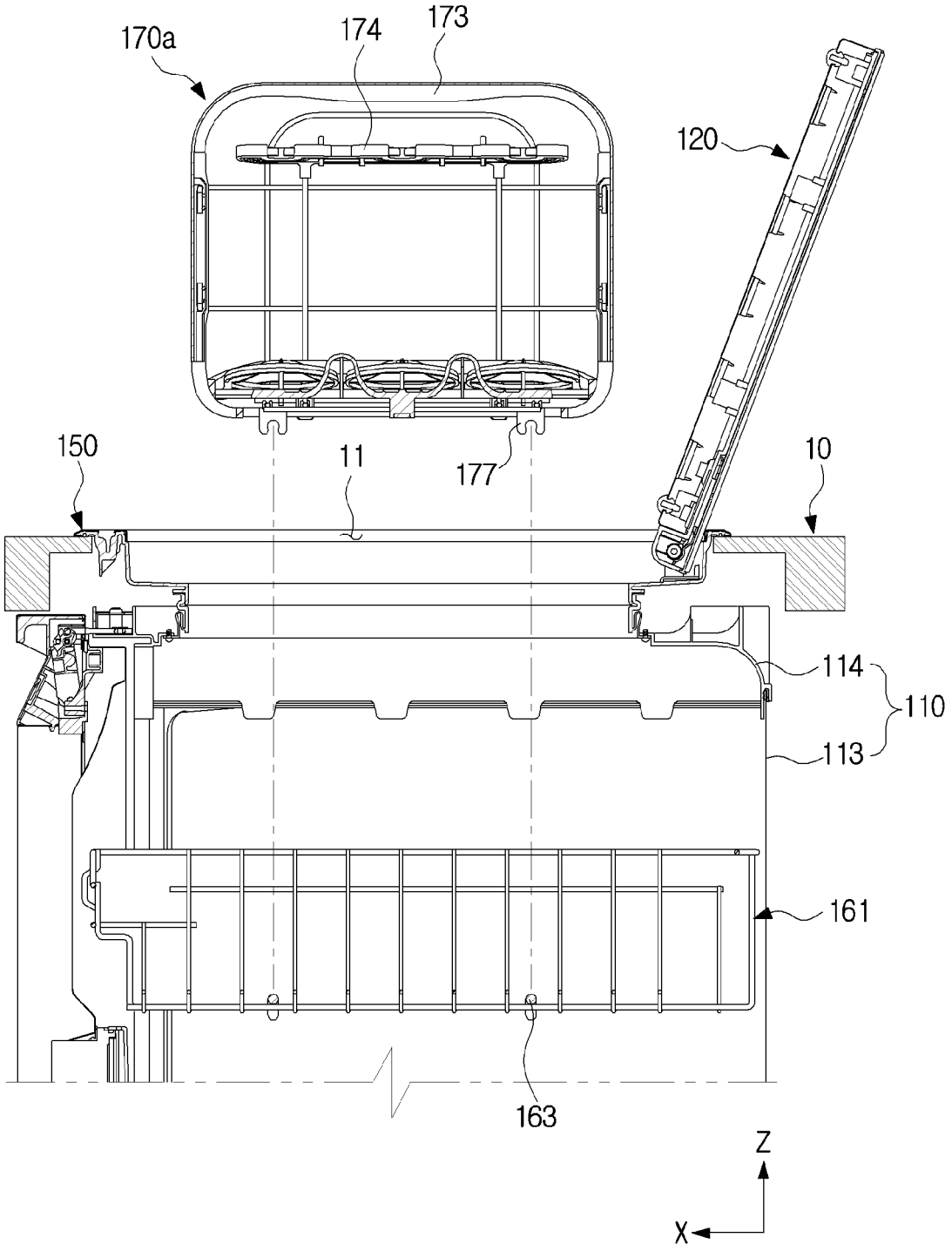

【FIG. 10】
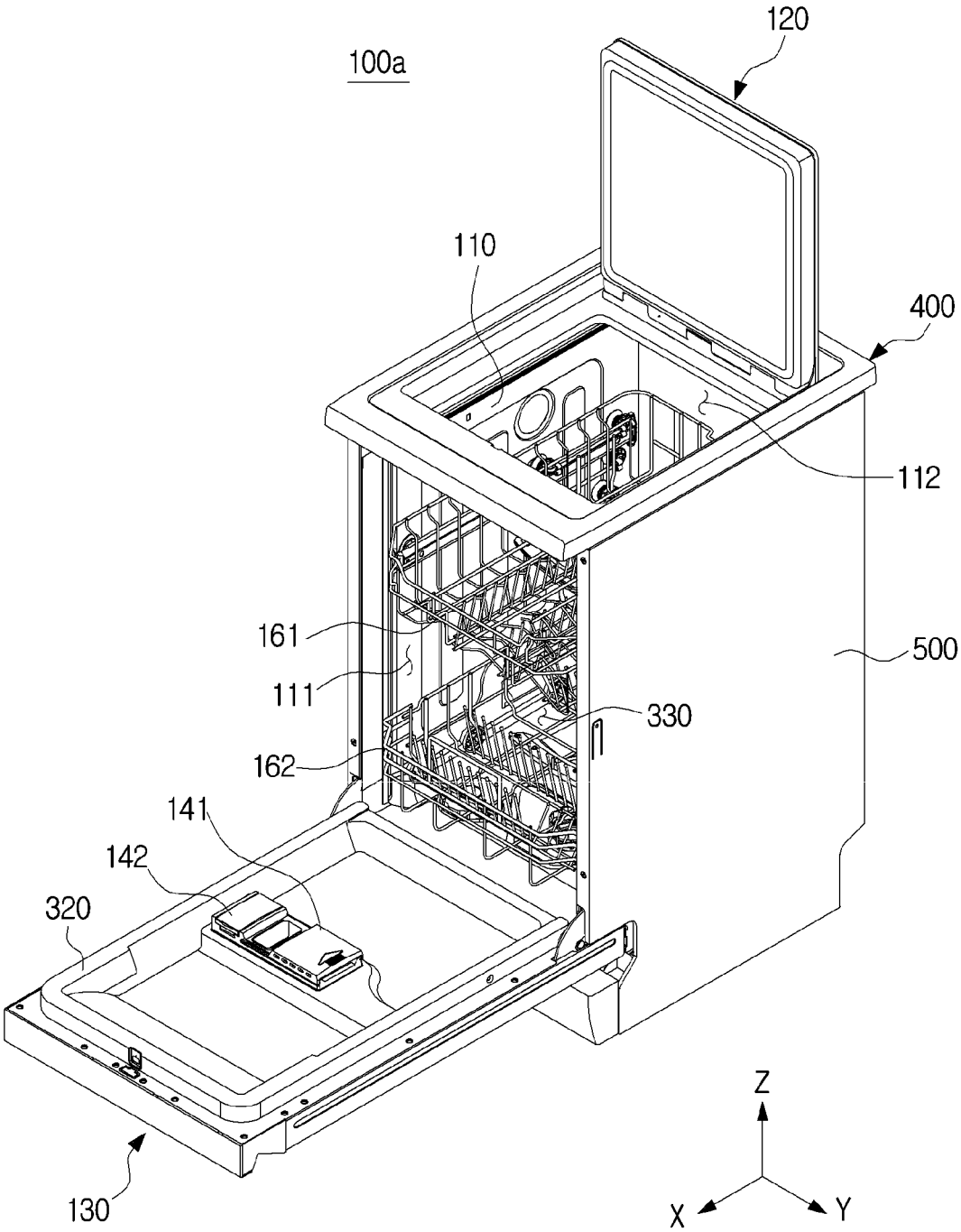

【FIG. 11】
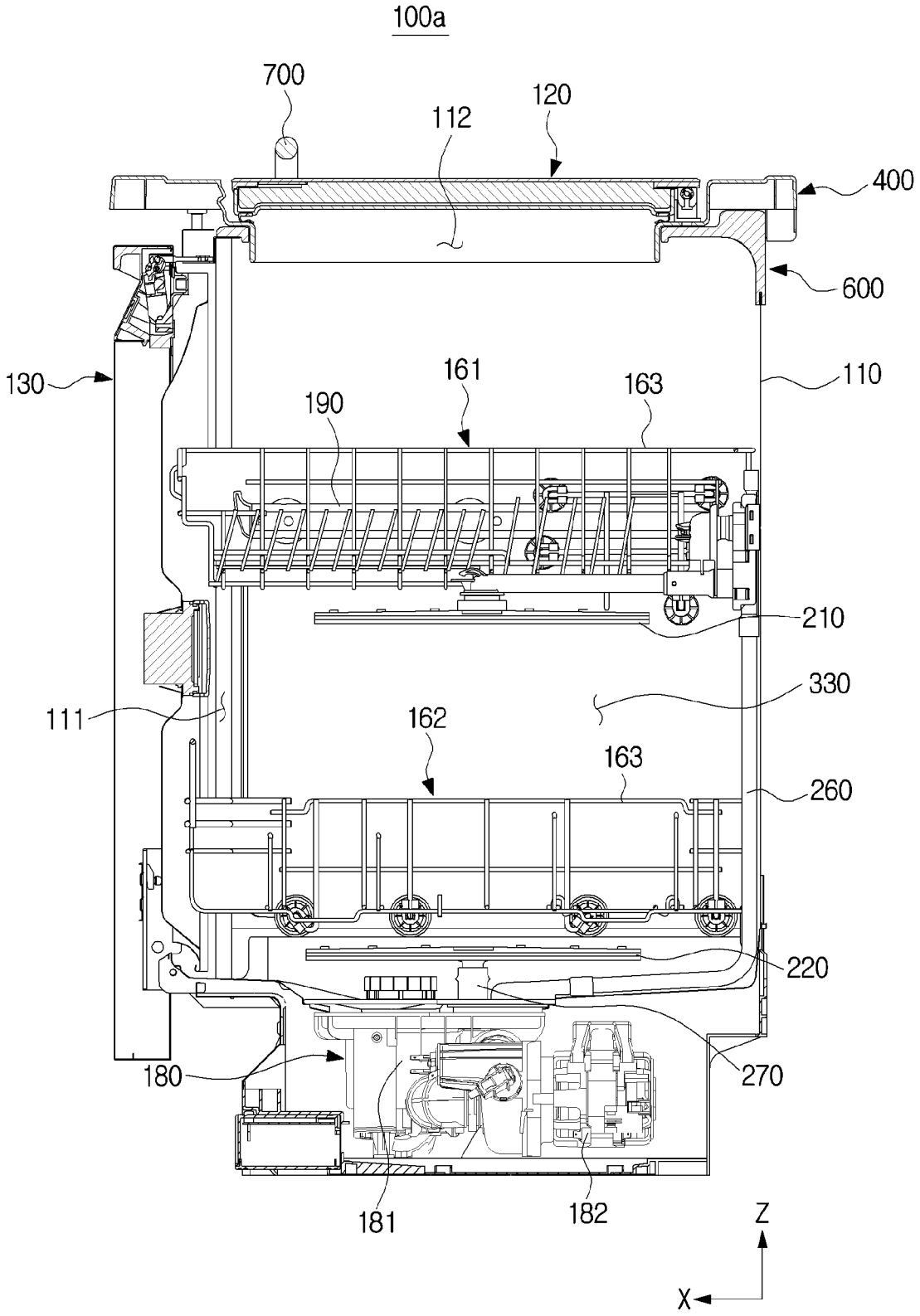

【FIG. 12】
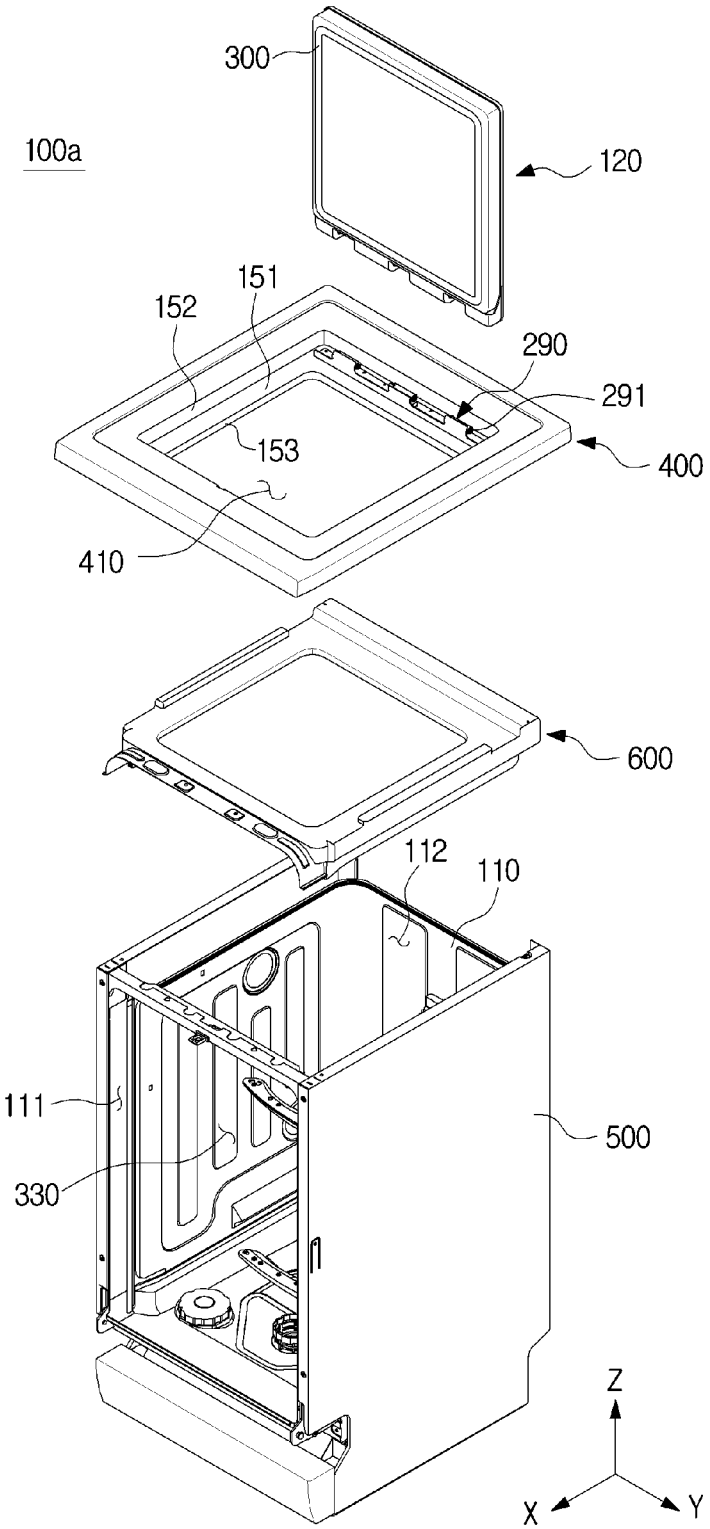

【FIG. 13A】
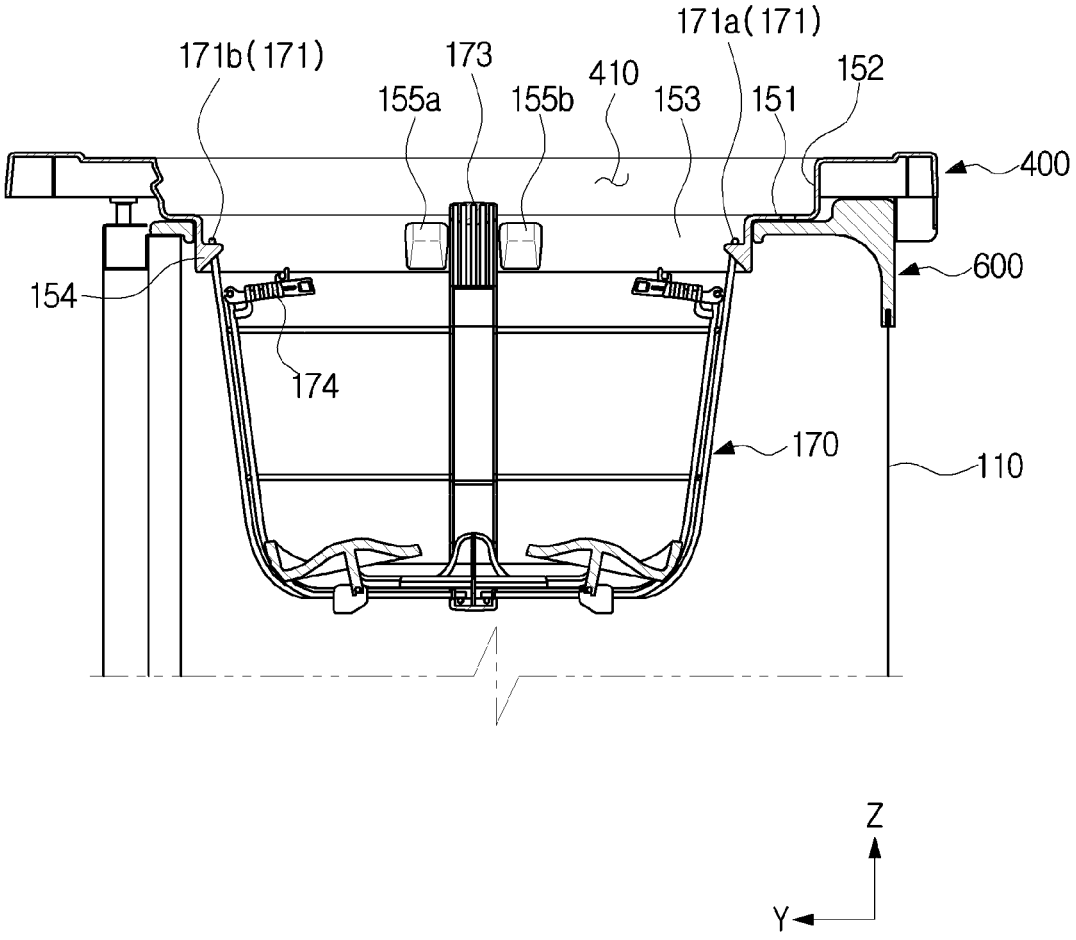

【FIG. 13B】
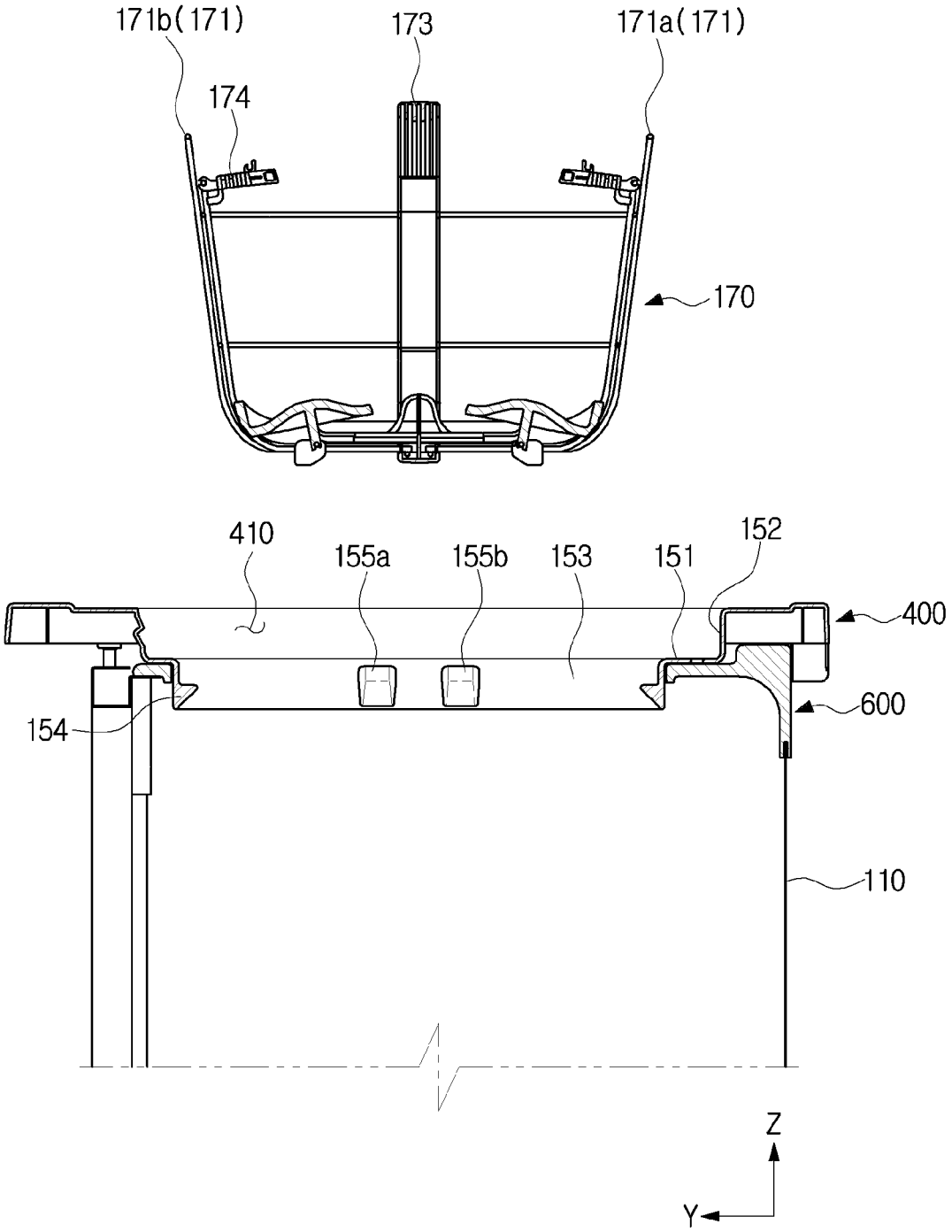

【FIG. 14】
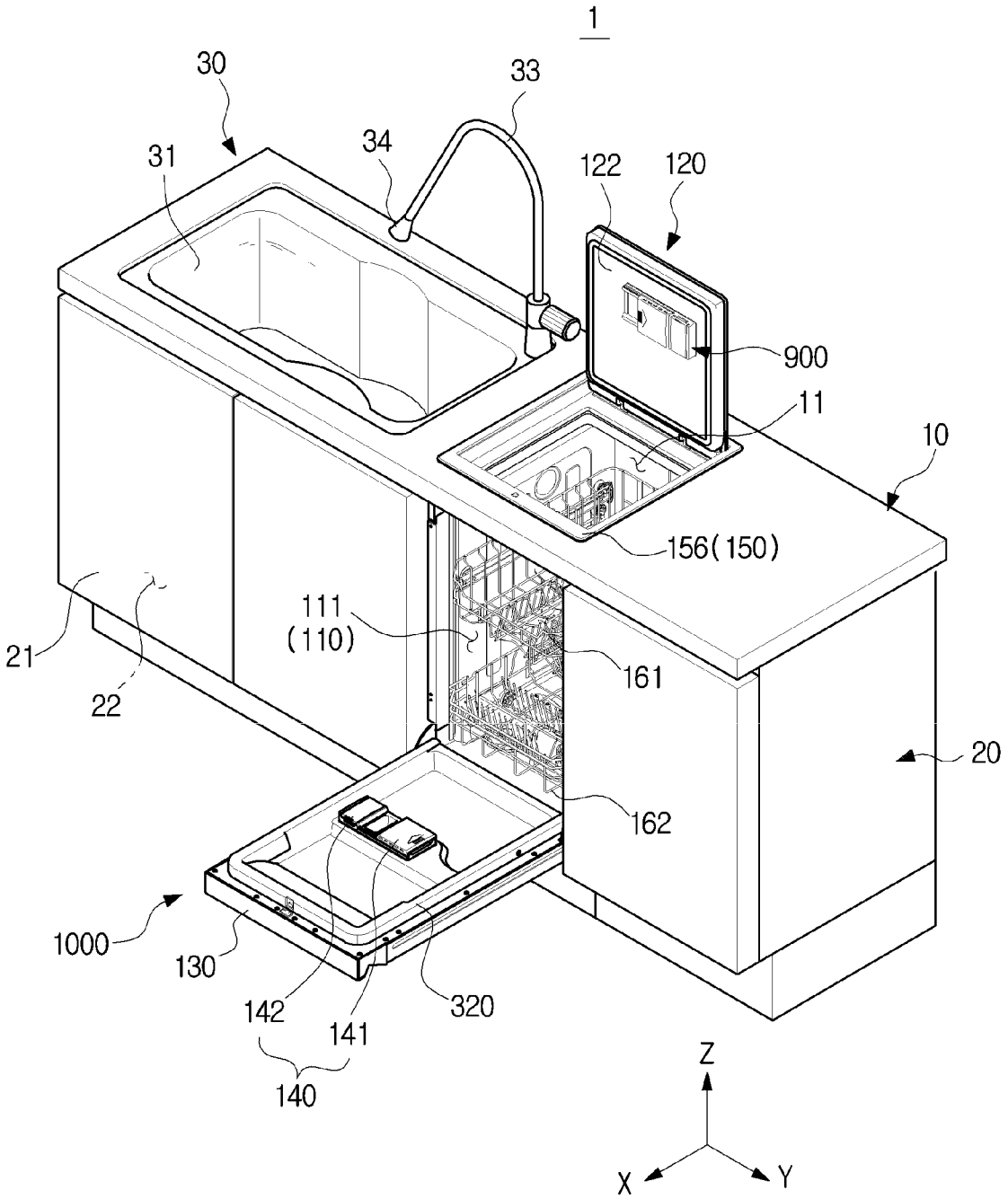

【FIG. 15】
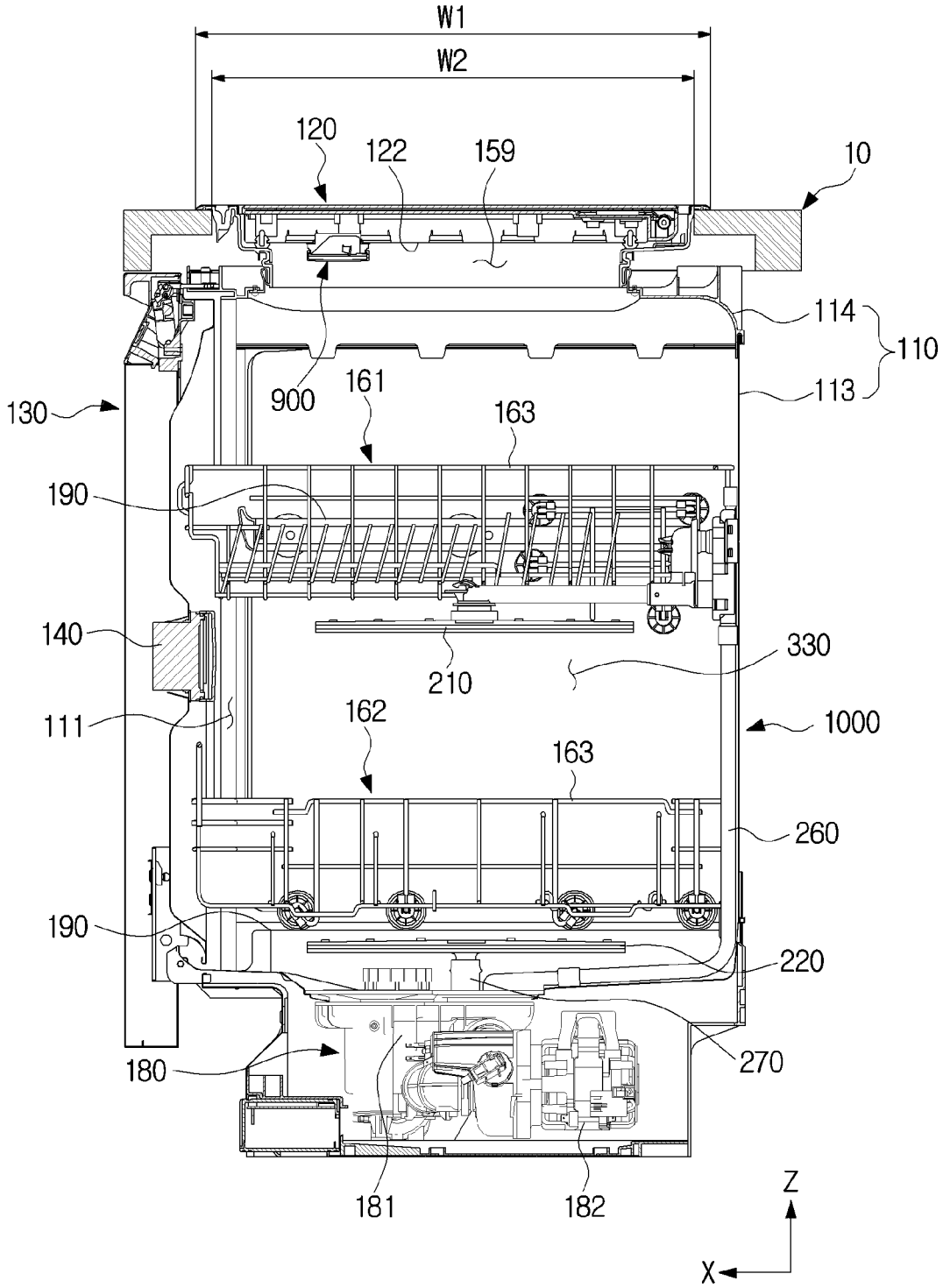

【FIG. 16】
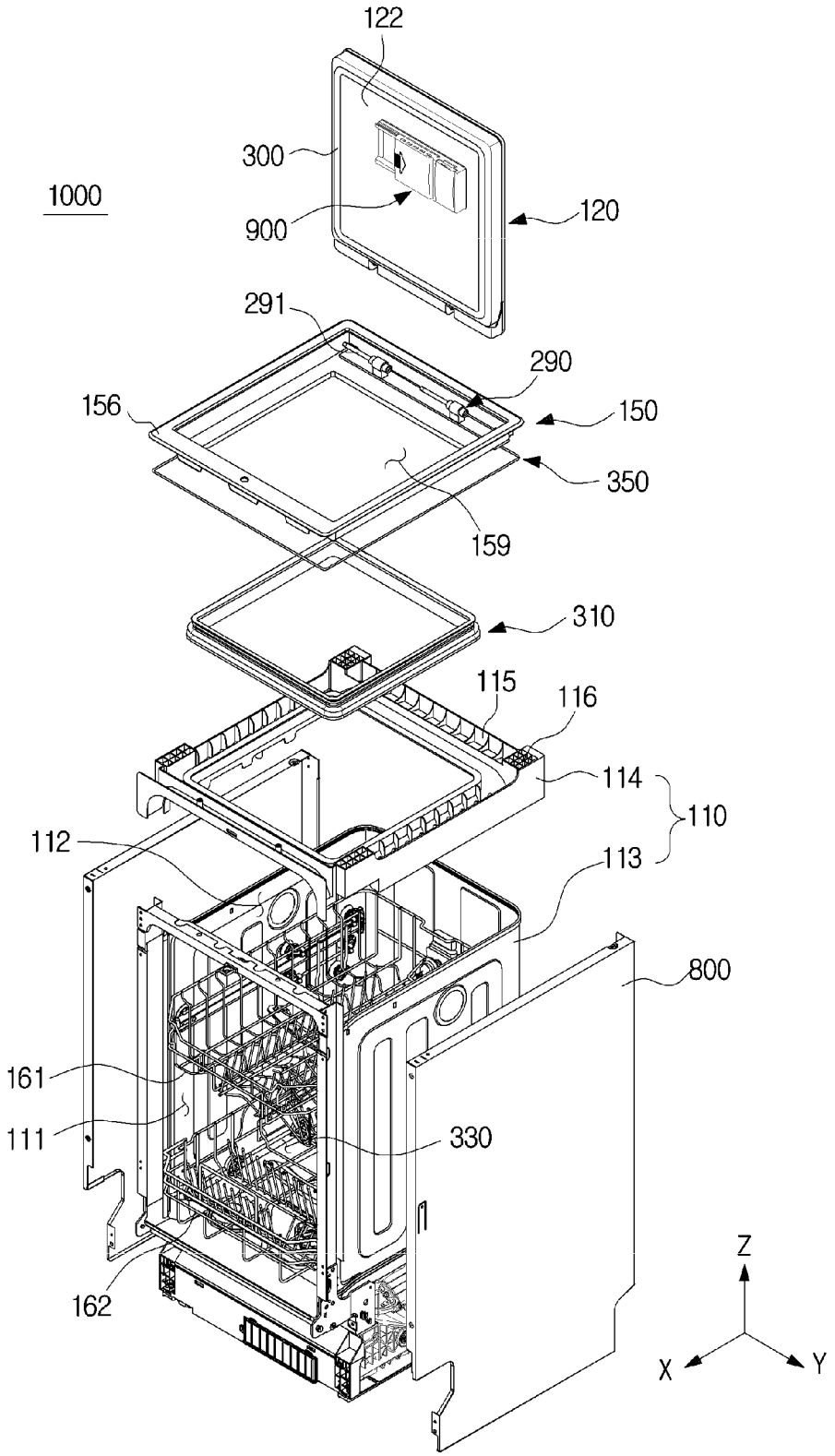

【FIG. 17】
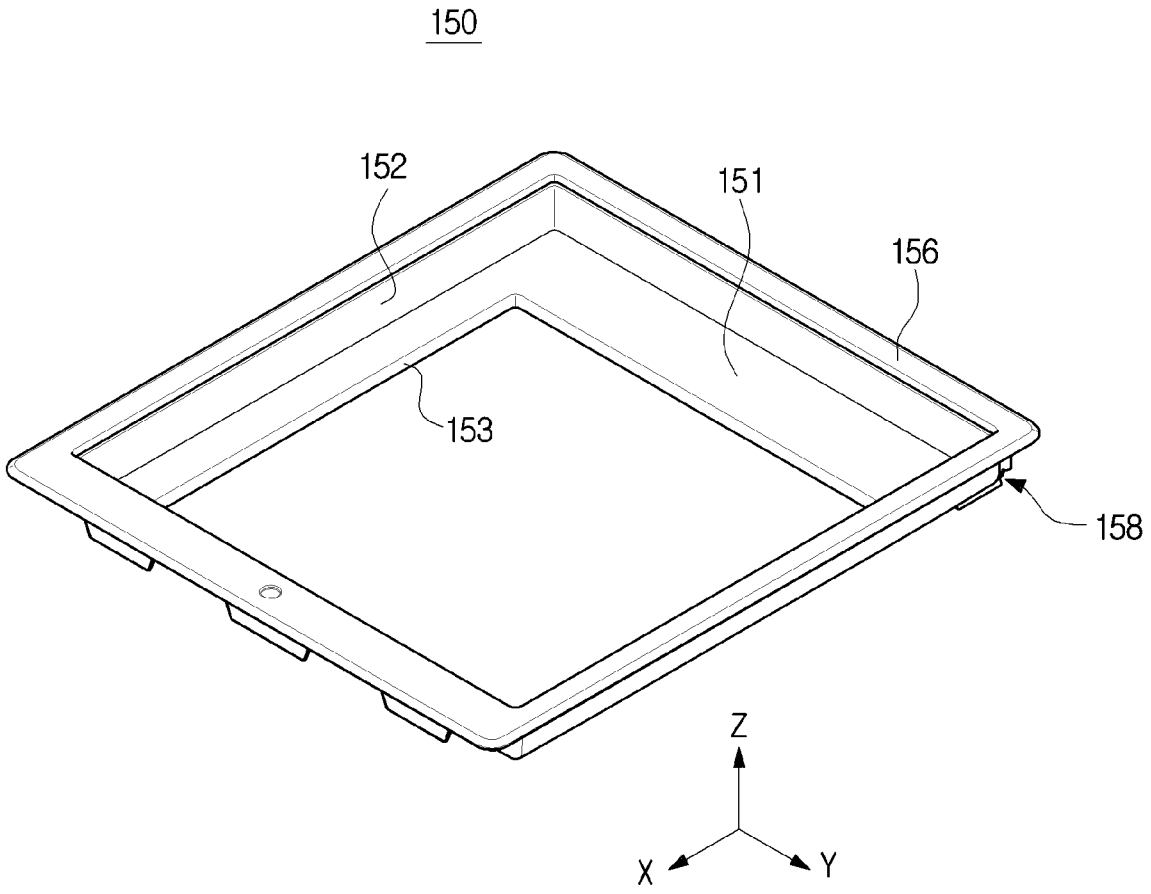

【FIG. 18A】
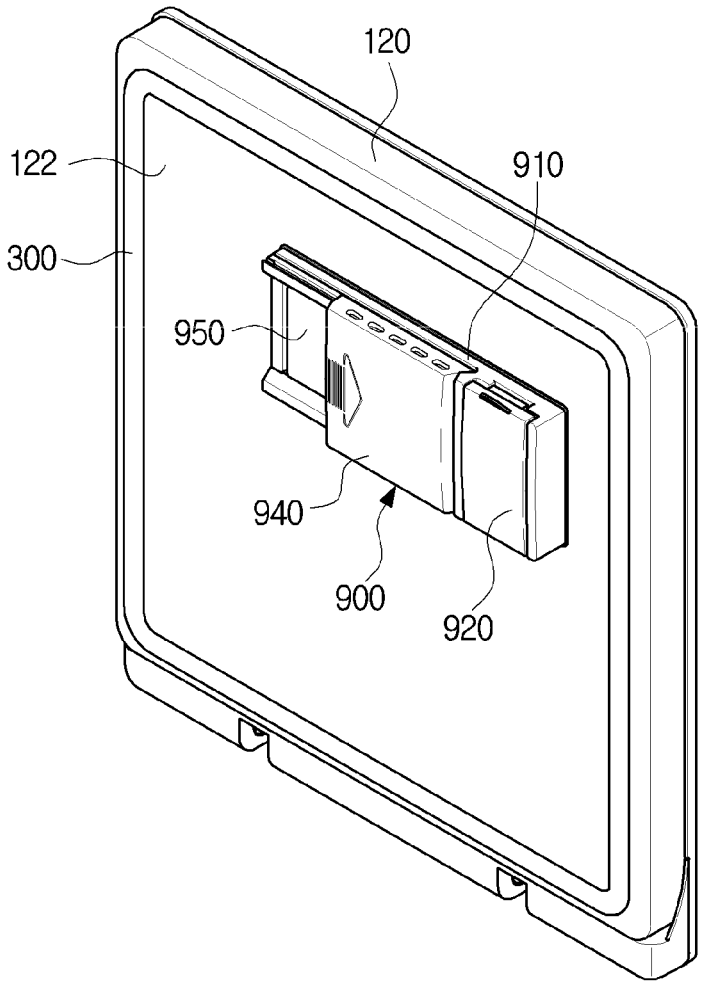

【FIG. 18B】
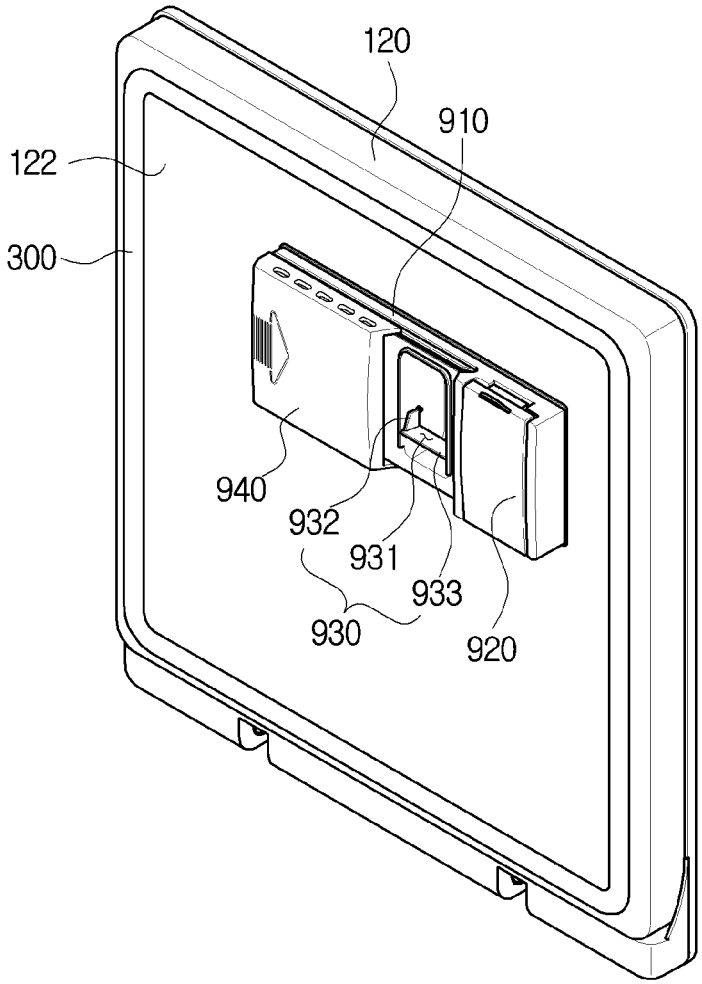

【FIG. 18C】
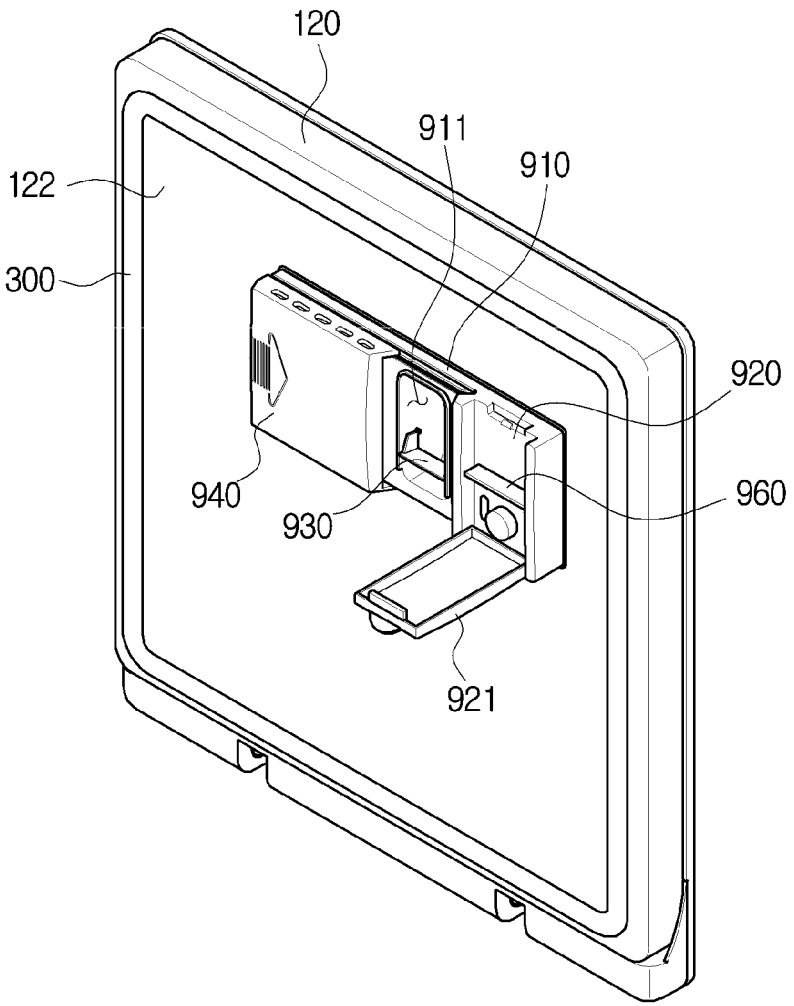

【FIG. 19A】
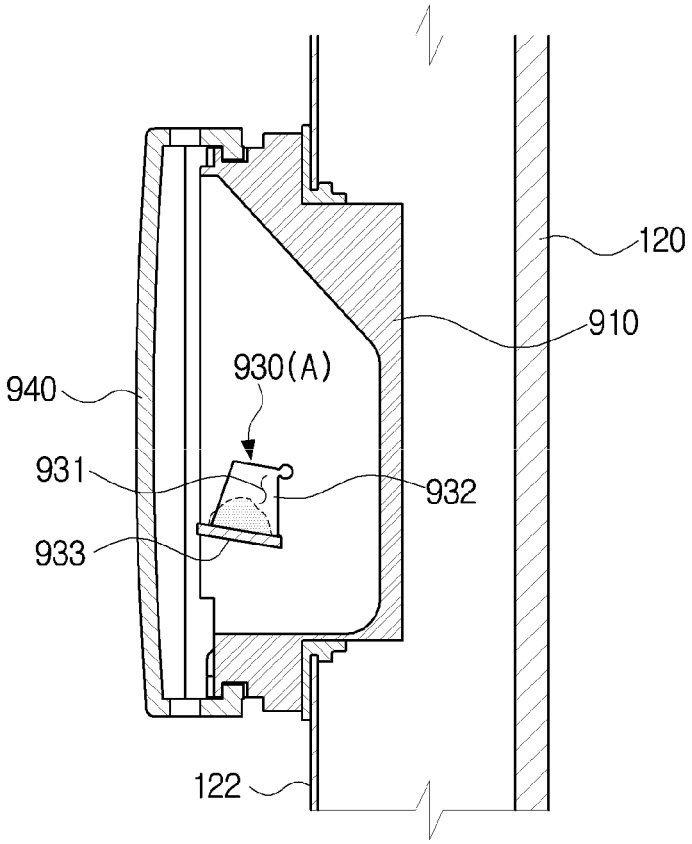

【FIG. 19B】
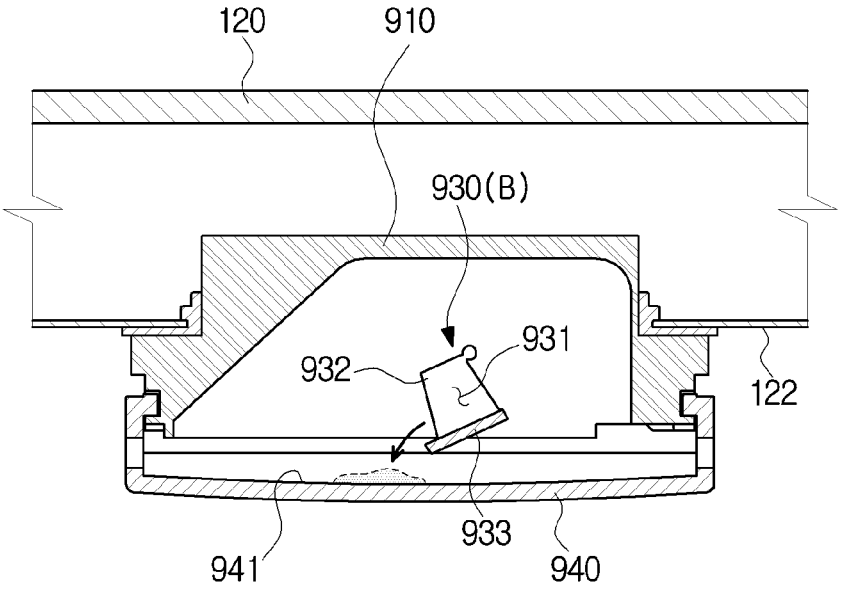

【FIG. 19C】
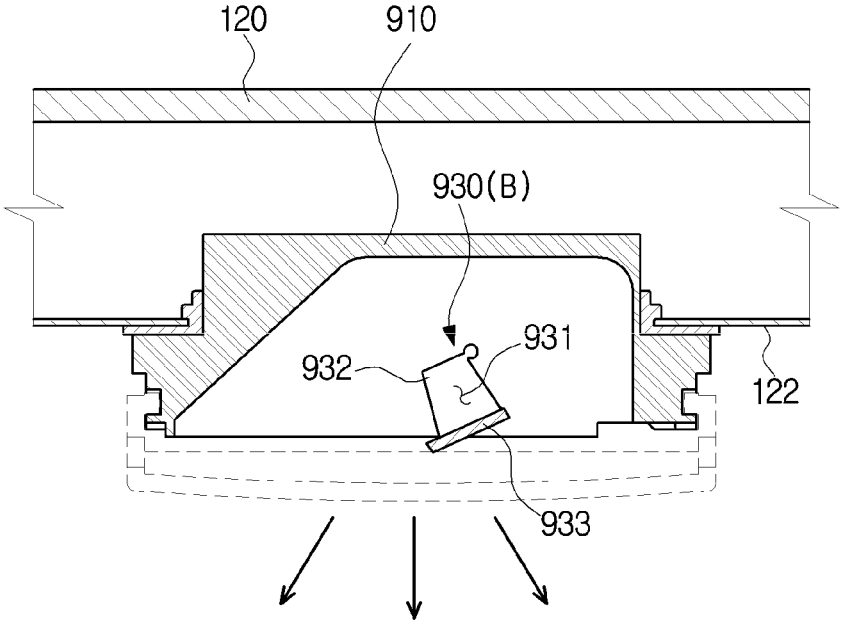

【FIG. 20】
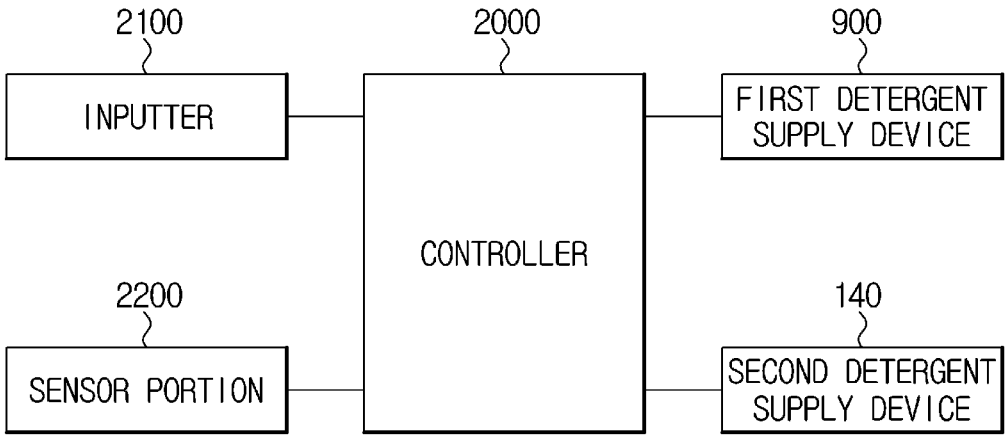

【FIG. 21】
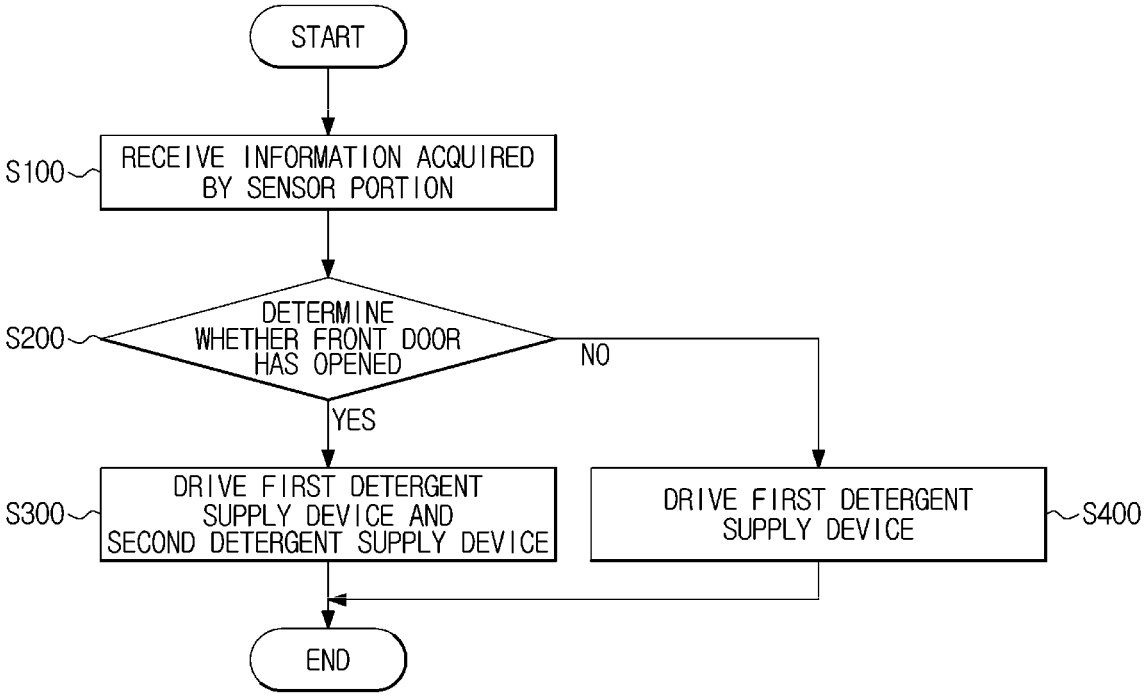

【FIG. 22】
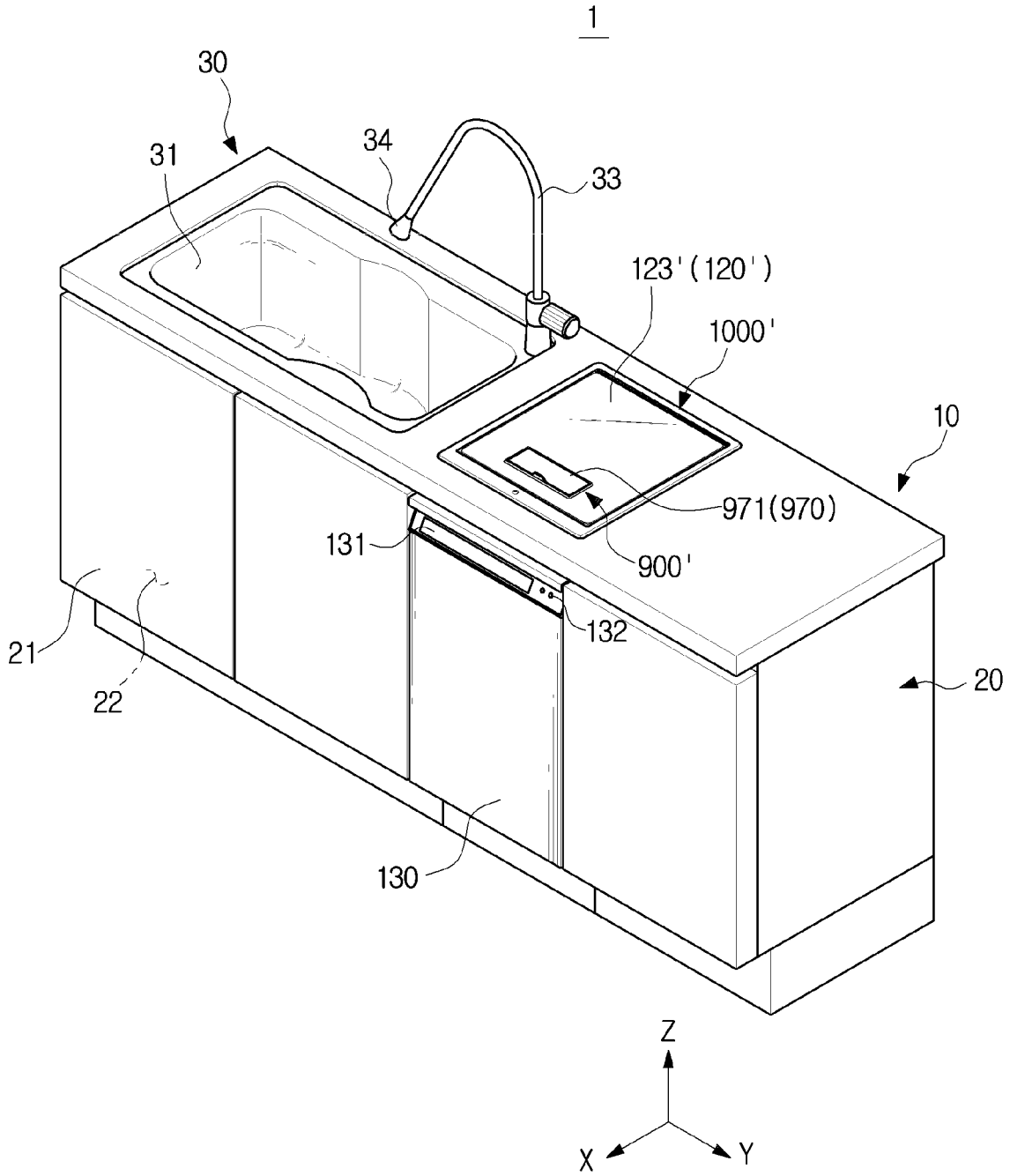

【FIG. 23】
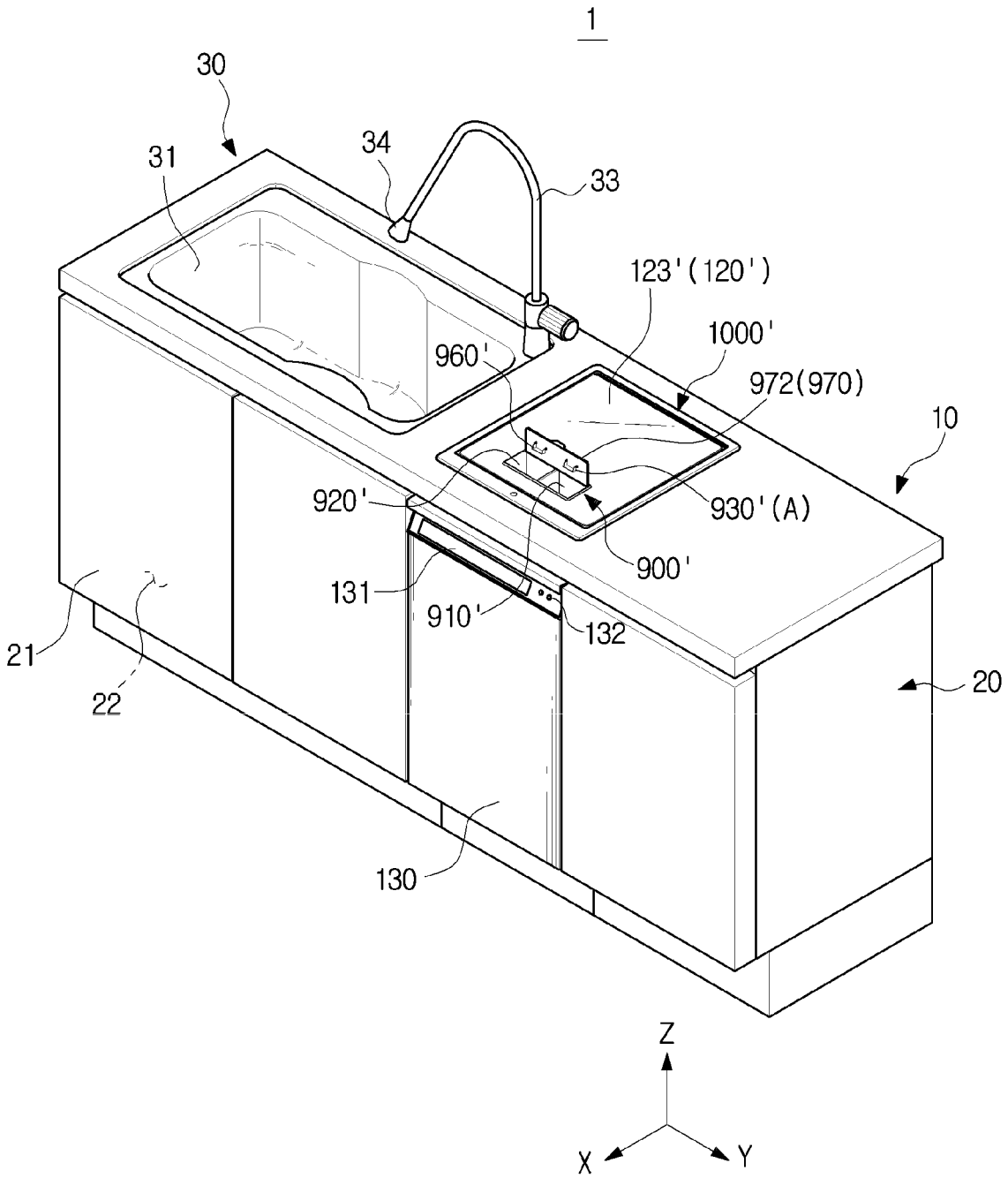

【FIG. 24】
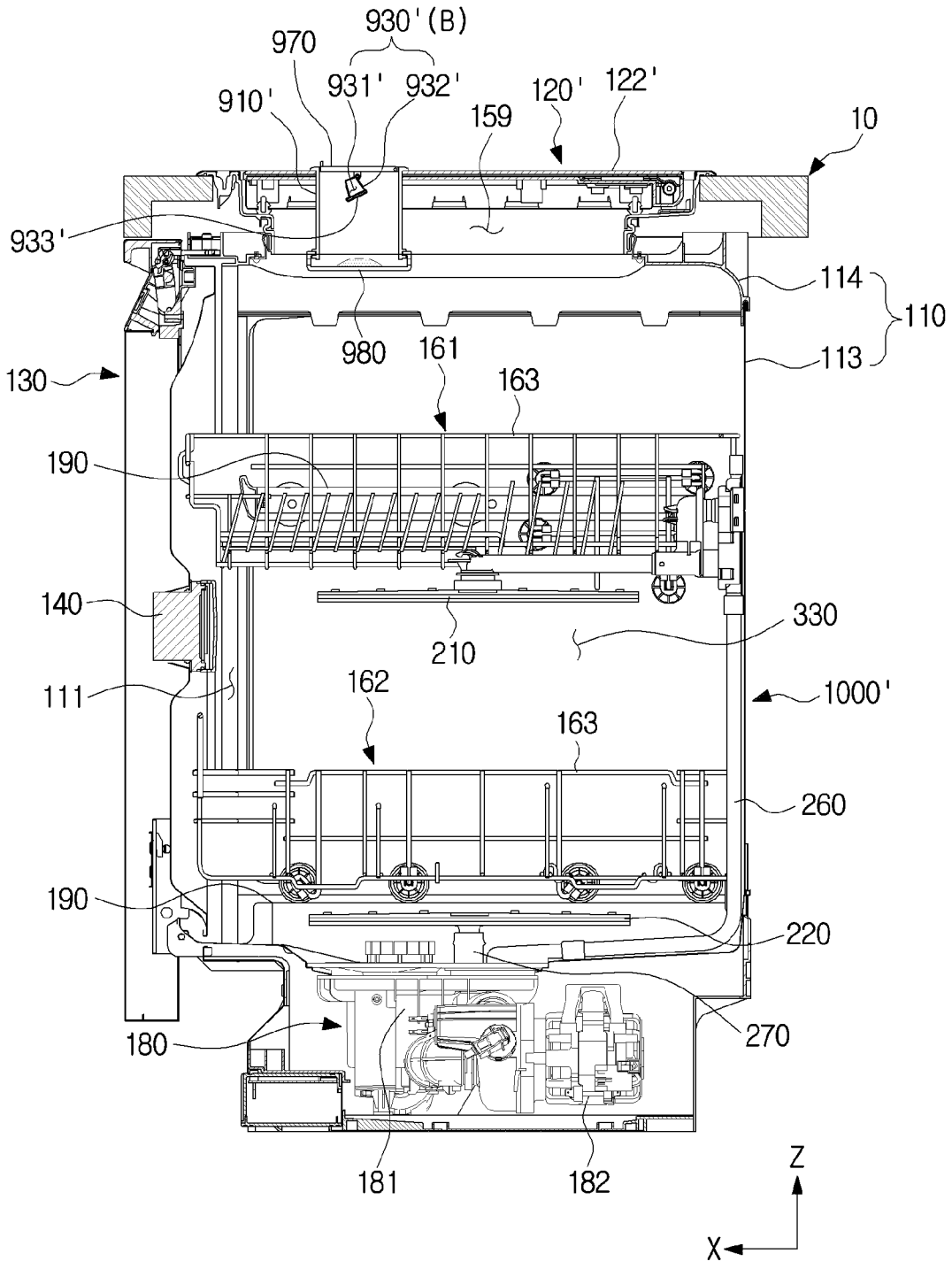

【FIG. 25】
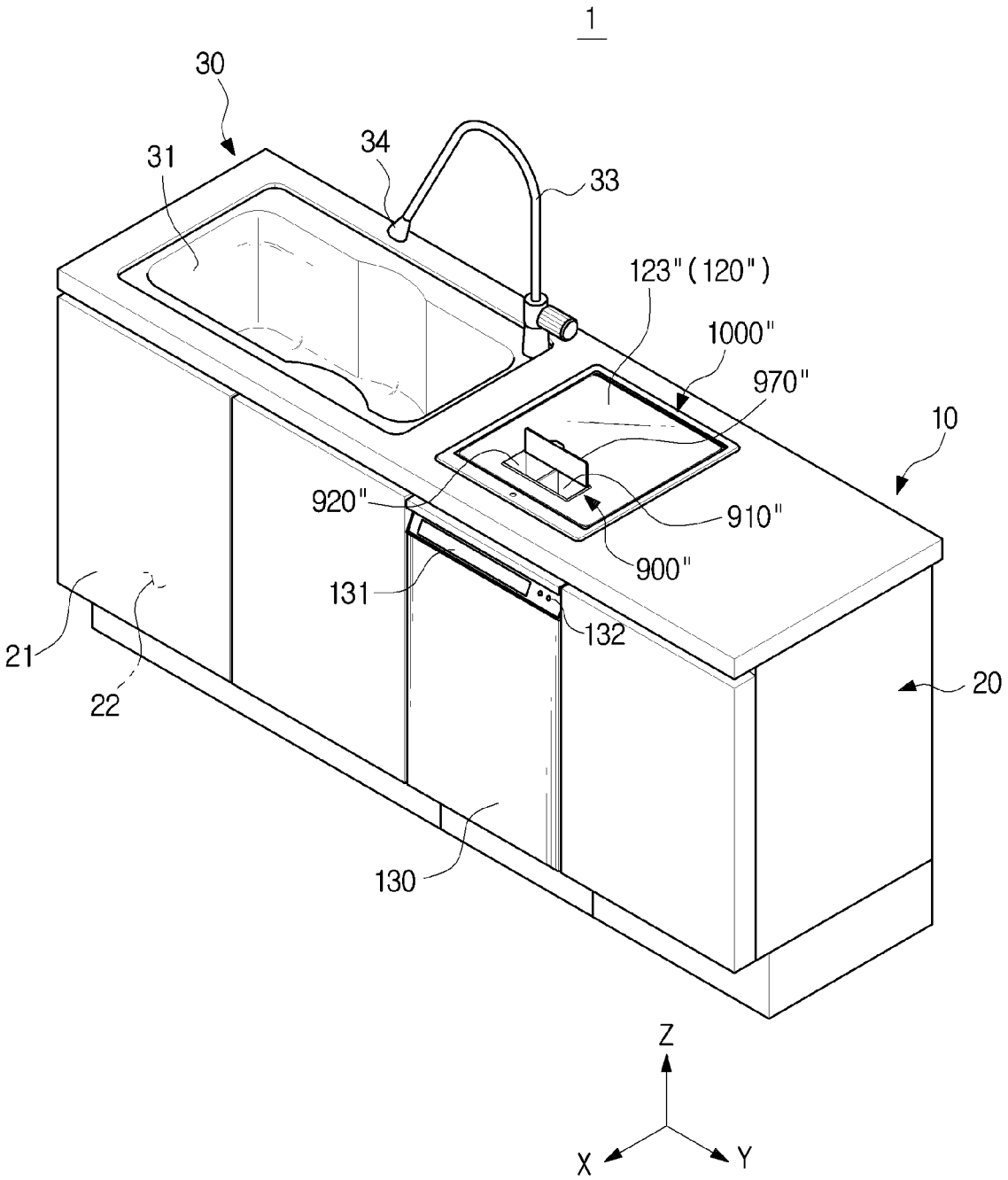

【FIG. 26】
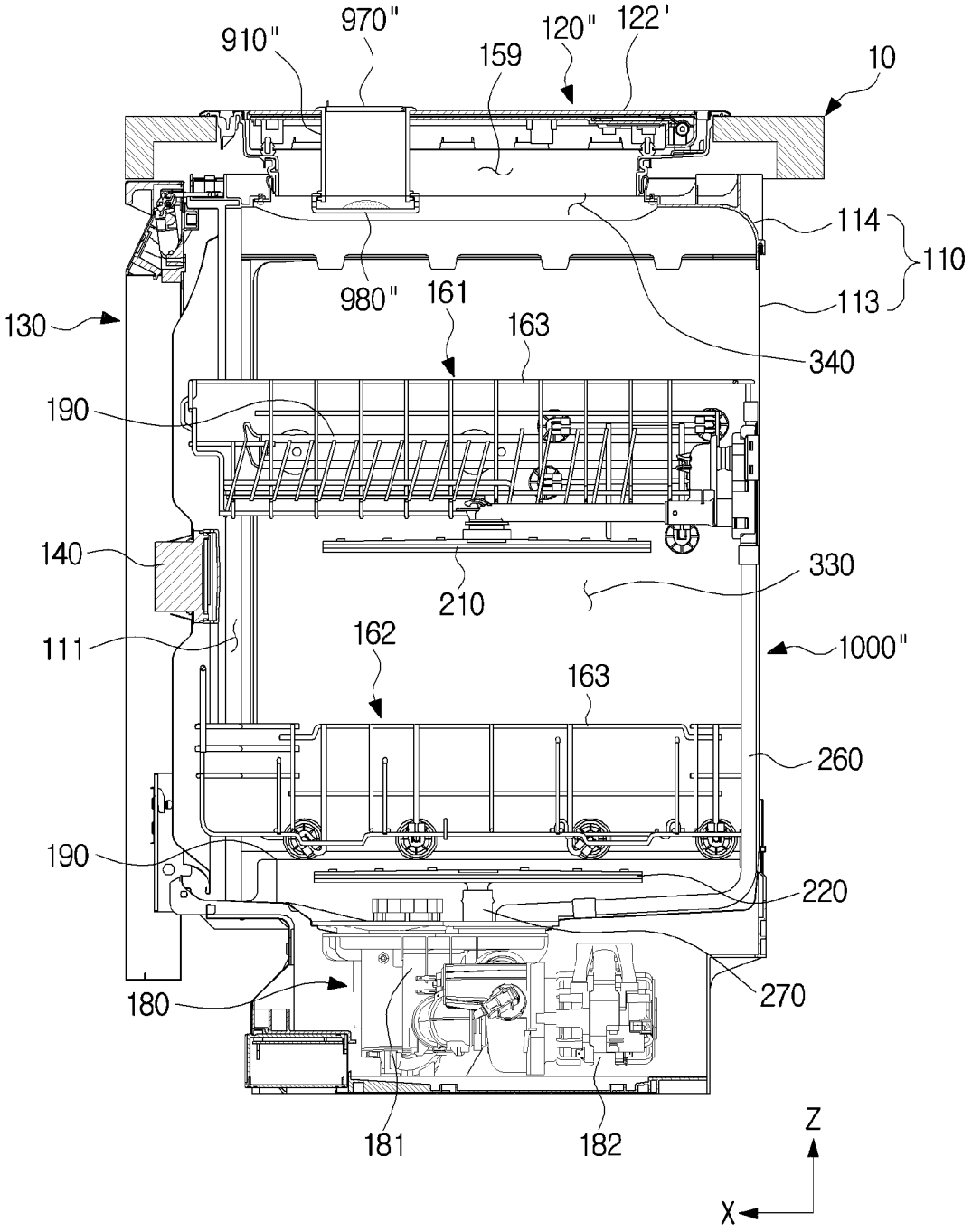

【FIG. 27】
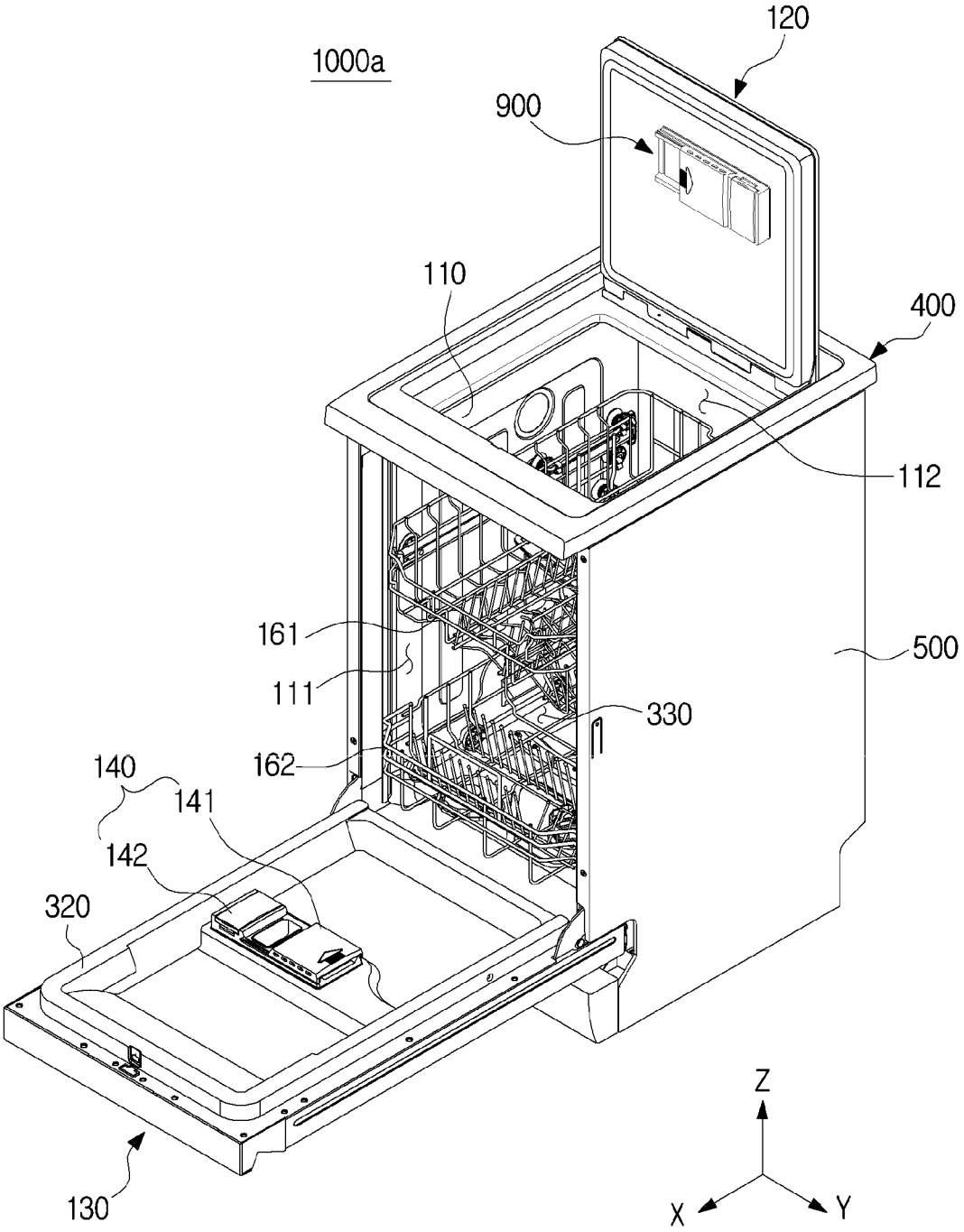

【FIG. 28】
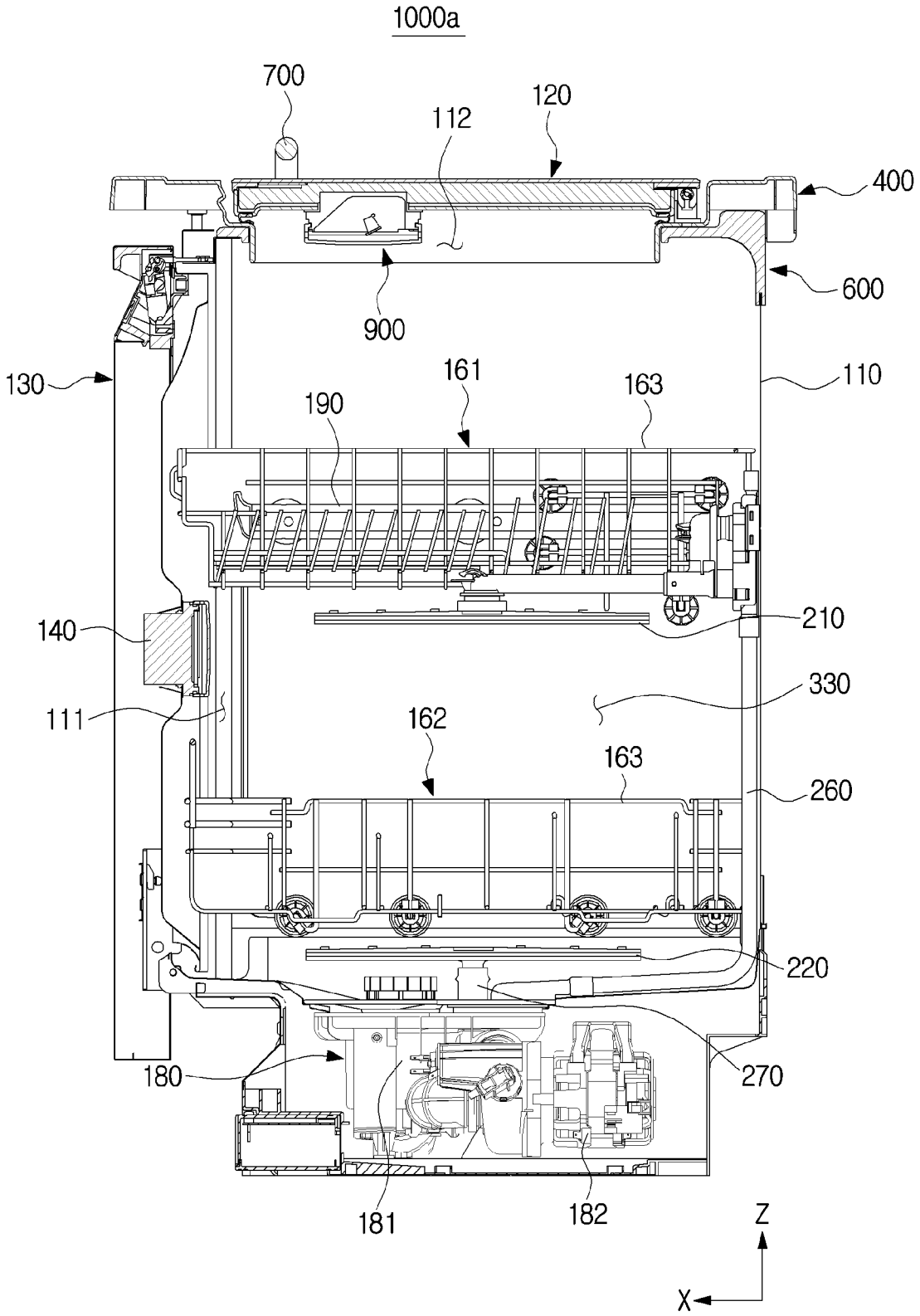

【FIG. 29】
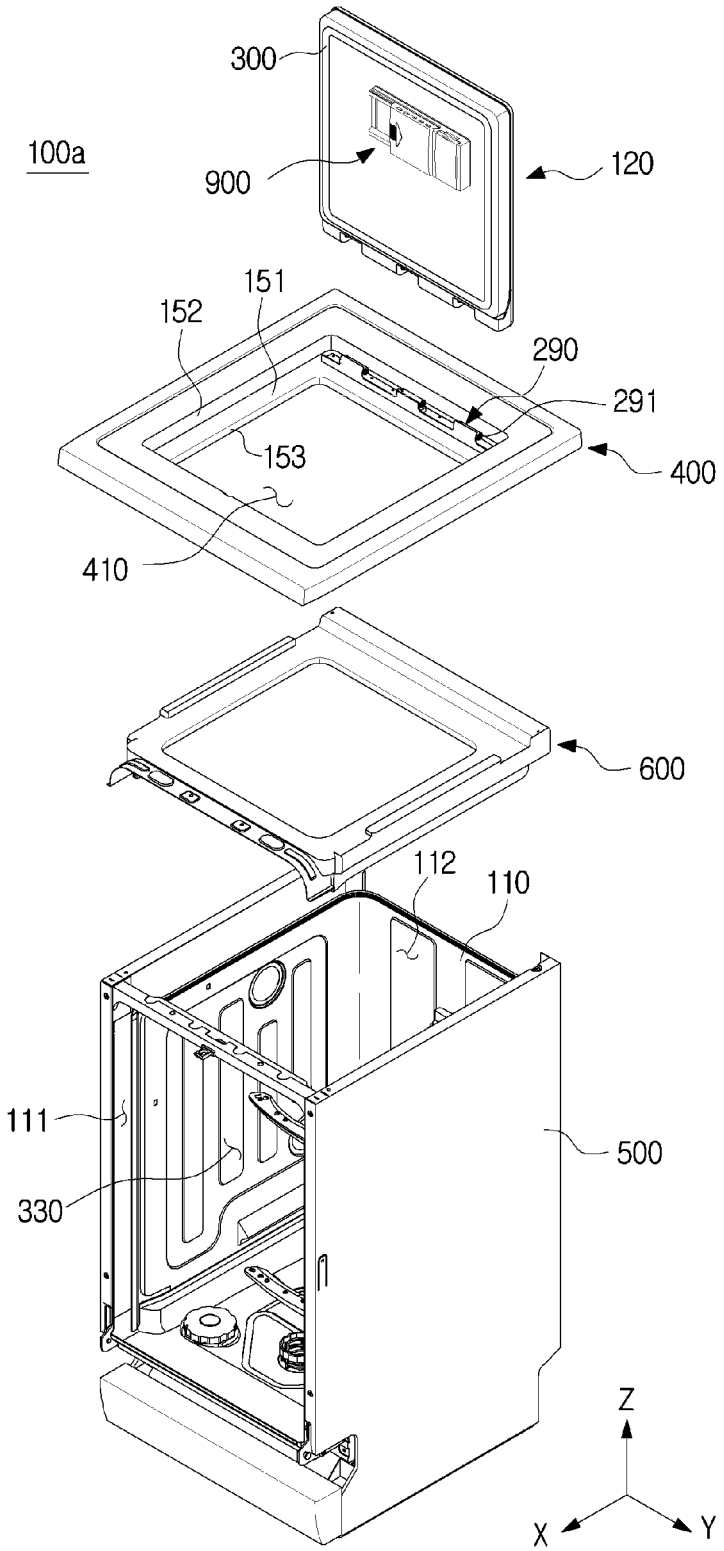

FRONT AND TOP LOADING DISHWASHER WITH RESTRICTED BASKET MOVEMENT

CROSS-REFERENCE TO RELATED APPLICATIONS

This application is a U.S. National Stage Application which claims the benefit under 35 U.S.C. § 371 of International Patent Application No. PCT/KR2018/005890 filed on May 24, 2018, which claims foreign priority benefit under 35 U.S.C. § 119 of Korean Patent Application No. 10-2017-0111458 filed on Aug. 31, 2017 and Application No. 10-2017-0111442 filed on Aug. 31, 2017, the contents of all of which are incorporated herein by reference.

TECHNICAL FIELD

The present disclosure relates to a dishwasher, and more particularly, to a dishwasher with a structure capable of improving ease of use.

BACKGROUND ART

A dishwasher is a machine for automatically removing food residues, and the like on dishes with a detergent and water.

For example, a dishwasher includes a main body having a front opening and having a tub in the inside, a door installed on the main body and configured to open or close the front opening, a basket accommodating dishes, and a spray nozzle configured to spray water. In the dishwasher, referred to as a front loading type dishwasher, food residues, etc. on dishes may fall on the installation surface of the dishwasher when the dishes are loaded in the basket.

As another example, a dishwasher includes a main body having a top opening and having a tub in the inside, a door installed on the main body and configured to open or close the top opening, a basket accommodating dishes, and a spray nozzle configured to spray water. The dishwasher, referred to as a top loading type of dishwasher, may have difficulties in loading dishes of a predetermined size or larger therein due to interference between the upper space of the tub and the door.

Accordingly, a new type of dishwasher capable of improving issues of the front loading type dishwasher and the top loading type dishwasher is required.

DISCLOSURE

Technical Problem

An aspect of the present disclosure provides a dishwasher with an improved structure to allow front loading and top loading of dishes.

Another aspect of the present disclosure provides a dishwasher having a basket that is taken out of the dishwasher in an upward direction.

Another aspect of the present disclosure provides a dishwasher with an improved structure to enlarge a washing space.

Another aspect of the present disclosure provides a dishwasher to which a detergent is easily supplied through a top door.

Technical Solution

A dishwasher according to a concept of the present disclosure may be installed in a built-in type in a system kitchen including a cabinet having an accommodating space and a counter positioned on the cabinet and including an opening. The dishwasher may include: a tub including a front opening; a front door configured to open or close the front opening; a top door configured to open or close the opening of the counter; a basket positioned in the inside of the tub, the basket being taken out through the front opening; and an additional basket being taken out through the opening of the counter.

The additional basket may be positioned above the basket.

The additional basket may be rested on the basket.

The dishwasher according to the concept of the disclosure may further include a cover frame installed in the opening such that the top door is mounted on the cover frame, wherein taking-out of the additional basket through the front opening is limited by the cover frame.

The additional basket may include a handle, and taking-out of the additional basket through the front opening may be limited by interference between the handle and the cover frame.

The additional basket may be rested on the cover frame.

In an inner wall of the cover frame, a support may protrude toward an inside of the cover frame such that the additional basket is hung on the support.

The additional basket may be rested in the basket.

The additional basket may be positioned such that at least one portion of the additional basket is accommodated in an inside of the basket.

The basket may include: a upper basket positioned adjacent to the additional basket; and a lower basket positioned below the upper basket in a up-down direction of the dishwasher, wherein, when at least one portion of the additional basket is accommodated in the upper basket, taking-out of the upper basket from the tub may be limited.

The upper basket may be formed by a plurality of wires crossing each other to accommodate dishes therein, and the additional basket may include a coupling portion detachably coupled to at least one of the plurality of wires.

A dishwasher according to a concept of the present disclosure may include: a tub including a front opening and a top opening; a front door configured to open or close the front opening; a cover frame including an opening corresponding to the top opening and positioned on the tub; a top door mounted on the cover frame and configured to open or close the opening of the cover frame; and a top loading basket being taken out through the opening of the cover frame, wherein taking-out of the top loading basket through the front opening is limited by the cover frame.

The top loading basket may include a top loading basket body in which dishes are accommodated, and a handle coupled to the top loading basket body, wherein taking-out of the top loading basket through the front opening may be limited by interference between the handle and the cover frame.

The dishwasher according to the concept of the disclosure may further include a front loading basket positioned in an inside of the tub and being taken out through the front opening.

The top loading basket may be rested on the front loading basket.

The top loading basket may be positioned such that at least one portion of the top loading basket is accommodated in an inside of the front loading basket.

When at least one portion of the top loading basket is accommodated in the front loading basket, taking-out of the front loading basket from the tub may be limited.

The top loading basket may be rested on the cover frame.

On an inner wall of the cover frame, a support may protrude toward an inside of the cover frame such that the top loading basket is hung on the support.

A dishwasher according to a concept of the disclosure may include: a tub including a front opening and a top opening; a front door configured to open or close the front opening; a cover frame including an opening corresponding to the top opening and positioned on the tub; a top door mounted on the cover frame and configured to open or close the opening of the cover frame; a basket being taken out through the front opening of the tub; and an additional basket being taken out through the opening of the cover frame, wherein taking-out of the basket from the tub is limited when at least one portion of the additional basket is accommodated in an inside of the basket.

A dishwasher according to a concept of the disclosure may include: a tub including a front opening and a top opening; a front door configured to open or close the front opening; a top door configured to open or close the top opening; and a detergent supply device positioned on the top door, configured to supply a detergent to the tub, and including a detergent case and a detergent resting member positioned in an inside of the detergent case and being rotatable, wherein the detergent resting member moves between a first location at which the detergent is rested on the detergent resting member and a second location at which the detergent escapes from the detergent resting member.

The detergent resting member may include a resting portion on which the detergent is rested and a rotating portion rotatably coupled to one side of the detergent case, and the rotating portion may be coupled to the one side of the detergent case such that the detergent resting member rotates between the first location and the second location.

The detergent resting member may rotate between the first location and the second location, interworking with the top door, according to a degree of opening of the top door. When the top door opens, the detergent resting member may be positioned at the first location, and, when the top door is closed, the detergent resting member may be positioned at the second location.

The detergent resting member may rotate from the first location to the second location by a weight of the detergent resting member.

The detergent supply device may further include a cover that slides in one direction to open or close the detergent case.

The dishwasher according to the concept of the disclosure may further include a washing device positioned in an inside of the tub, an additional detergent supply device positioned on the front door, and a controller configured to control the detergent supply device and the additional detergent supply device.

When the washing device is driven in the state in which the front door is not opened, the controller may slide the cover to open the detergent case.

The controller may control the additional detergent supply device such that the additional detergent supply device is not driven.

The dishwasher according to the concept of the disclosure may further include an upper basket positioned in the inside of the tub, the upper basket being taken out through the top opening of the tub, wherein the controller may slide the cover to open the detergent case when the washing device is driven in the state in which objects to be washed are rested in the upper basket.

The detergent supply device may further include a rinse case, and a rinse resting member which is positioned in an inside of the rinse case and on which a rinse is rested when the top door opens.

The rinse resting member may include a rinse resting portion on which the rinse is rested, wherein the rinse is rested on the rinse resting portion when the top door opens.

The dishwasher according to the concept of the disclosure may further include a cover frame positioned between the top door and the tub, wherein the top door is configured to open or close the cover frame.

The detergent supply device may penetrate a top surface and a lower surface of the top door, and the detergent supply device may include a first cover configured to open or close the detergent case from the top surface of the top door, and a second cover configured to cover the detergent case from the lower surface of the top door.

The detergent supply device may be configured to receive a detergent from an outside through the first cover when the top door is in a closed state.

The detergent supply device may further include a controller configured to control the detergent supply device, and the controller may slide the second cover to open the detergent case when a detergent is supplied to the detergent case from an outside.

A dishwasher according to a concept of the disclosure may include: a tub including a front opening and a top opening; a washing device positioned in an inside of the tub; a front door configured to open or close the front opening; a top door configured to open or close the top door; a first detergent supply device positioned on the top door; a second detergent supply device positioned on the front door; and a controller configured to control the first detergent supply device and the second detergent supply device such that only the first detergent supply device is driven when the washing device is driven in the state in which the front door is not opened.

The controller may control the first detergent supply device and the second detergent supply device such that at least any one of the first detergent supply device and the second detergent supply device is driven when the washing device is driven after the front door opens.

The dishwasher according to the concept of the disclosure may further include a upper basket positioned in the inside of the tub and being taken out through the top opening of the tub, wherein the controller slides the cover to open the detergent case when the washing device is driven in the state in which objects to be washed are rested in the upper basket.

The first detergent supply device may include a detergent case, and a detergent resting member positioned in an inside of the detergent case and being rotatable, wherein the detergent resting member is positioned at a first location when the top door opens and at a second location when the top door is closed.

A dishwasher according to a concept of the disclosure may be installed in a built-in type in a system kitchen including a cabinet having an accommodating space and a counter positioned on the cabinet and including an opening. The dishwasher may include: a tub including a front opening; a front door configured to open or close the front opening of the tub; a cover frame positioned on the tub and installed in the opening; a upper door configured to open or close the opening; a first detergent supply device positioned on the top door and configured to supply a detergent to the tub from above, and a second detergent supply device positioned on the front door and configured to supply a detergent to the tub in front of the tub.

Advantageous Effects

A dishwasher having a front door and a top door can be implemented to allow both front loading and top loading of dishes.

By using a basket that is taken out in a front direction through a front door and an additional basket that is taken out in an upward direction through a top door for a dishwasher, consumer convenience can be improved.

Because dishes are washed in a second washing space as well as a first washing space, a wide washing space can be secured compared to a typical dishwasher having only a first washing space.

In a dishwasher having a front door and a top door, the dishwasher may include a detergent supply device installed on the top door such that a user opens the top door and easily supplies a detergent to the dishwasher. The detergent supply device includes a detergent resting portion rotating when the top door opens, so that a user can easily supply a detergent through a simple configuration.

DESCRIPTION OF DRAWINGS

FIG. 1 shows a system kitchen where a dishwasher according to a first embodiment of the disclosure is installed in a built-in type.

FIG. 2 shows a state in which a front door and a top door of a first dishwasher open in the system kitchen of FIG. 1.

FIG. 3 is a cross-sectional view of the system kitchen of FIG. 1.

FIG. 4 is an exploded perspective view of the dishwasher according to the first embodiment of the disclosure.

FIG. 5 is a perspective view of an additional basket of the dishwasher according to the first embodiment of the disclosure.

FIG. 6 is a perspective view of a cover frame of the dishwasher according to the first embodiment of the disclosure.

FIG. 7 is an enlarged view of a portion of FIG. 3.

FIGS. 8A and 8B show a process in which the additional basket is taken out of the dishwasher according to the first embodiment of the disclosure.

FIGS. 9A and 9B show a process in which an additional basket is taken out of a dishwasher according to a second embodiment of the disclosure.

FIG. 10 shows a dishwasher according to a third embodiment of the disclosure.

FIG. 11 is a cross-sectional view of the dishwasher according to the third embodiment of the disclosure.

FIG. 12 is an exploded perspective view of the dishwasher according to the third embodiment of the disclosure.

FIGS. 13A and 13B show a process in which an additional basket is taken out of the dishwasher according to the third embodiment of the disclosure.

FIG. 14 shows a system kitchen where a dishwasher according to a fourth embodiment of the disclosure is installed in a built-in type.

FIG. 15 is a cross-sectional view of the system kitchen of FIG. 14.

FIG. 16 is an exploded perspective view of the dishwasher according to the fourth embodiment of the disclosure.

FIG. 17 is a perspective view of a cover frame of the dishwasher according to the fourth embodiment of the disclosure.

FIG. 18A shows a detergent supply device when a top door of the dishwasher according to the fourth embodiment of the disclosure opens.

FIG. 18B shows a state in which a detergent case of the detergent supply device of FIG. 18A opens.

FIG. 18C shows a state in which a rinse case of the detergent supply device of FIG. 18A opens.

FIG. 19A is a brief side cross-sectional view of the detergent supply device when the top door of the dishwasher according to the fourth embodiment of the disclosure opens.

FIG. 19B is a brief side cross-sectional view of the detergent supply device when the top door of the dishwasher according to the fourth embodiment of the disclosure is closed.

FIG. 19C is a brief side cross-sectional view of the detergent supply device of FIG. 19B when a detergent case opens.

FIG. 20 is a control block diagram of the detergent supply device of the dishwasher according to the fourth embodiment of the disclosure.

FIG. 21 is a control flow chart of the detergent supply device of the dishwasher according to the fourth embodiment of the disclosure.

FIG. 22 shows a system kitchen where a dishwasher according to a fifth embodiment of the disclosure is installed in a built-in type.

FIG. 23 shows a state in which a first cover of a first detergent supply device of the dishwasher opens, in the system kitchen of FIG. 22.

FIG. 24 is a side cross-sectional view of the dishwasher of FIG. 22.

FIG. 25 shows a state in which a first cover of a first detergent supply device of a dishwasher according to a sixth embodiment of the disclosure opens, in a system kitchen where the dishwasher is installed in a built-in type.

FIG. 26 is a side cross-sectional view of the dishwasher of FIG. 25.

FIG. 27 is a perspective view of a dishwasher according to a seventh embodiment of the disclosure.

FIG. 28 is a cross-sectional view of the dishwasher of FIG. 27.

FIG. 29 is an exploded perspective view of the dishwasher according to the seventh embodiment of the disclosure.

MODES OF THE INVENTION

Hereinafter, preferred embodiments of the disclosure will be described in detail with reference to the accompanying drawings. Meanwhile, the terms used throughout the specification "front end", "rear end", "upper", "lower", "upper end", "lower end", and the like are defined based on the drawings and the shape and position of each component are not limited by these terms.

FIG. 1 shows a system kitchen where a dishwasher according to a first embodiment of the disclosure is installed in a built-in type. FIG. 2 shows a state in which a front door and a top door of a first dishwasher open in the system kitchen of FIG. 1. Hereinafter, "X" represents a front-rear direction of a system kitchen 1, "Y" represents a left-right direction of the system kitchen 1, and "Z" represents a up-down direction of the system kitchen 1. The left-right direction of the system kitchen 1 is also referred to as a width direction of the system kitchen 1. The up-down direction of the system kitchen 1 is also referred to as a height direction of the system kitchen 1. Also, the front-rear direction, the left-right direction and the up-down direction of the system kitchen 1 are also respectively referred to as a front-rear direction, a left-right direction and a up-down direction of a dishwasher 100.

As shown in FIGS. 1 and 2, the system kitchen 1 may include a cabinet 20 having an accommodating space 22, and a counter 10 positioned on the cabinet 20. The counter 10 may be in the shape of a flat plate. The counter 10 is also referred to as a cooking table. In the counter 10, an opening 11 may be formed.

In the cabinet 20, the accommodating space 22 may be formed in which various kitchen supplies may be accommodated. The accommodating space 22 may be opened or closed by a cabinet door 21. For example, the cabinet door 21 may be rotatable.

The cabinet 20 may include a partition wall (not shown) therein to partition the accommodating space 22. For example, the partition wall may extend in a height direction Z of the system kitchen 1 to partition the accommodating space 22 into a plurality of spaces.

The system kitchen 1 may further include a sink 30 for enabling a user to wash dishes or prepare food materials, etc. The sink 30 may be provided in one side of the counter 10. The sink 30 may include a sink bowl 31 installed in the counter 10 to enable a user to wash dishes, food materials, etc. In the sink bowl 31, a drain (not shown) may be provided to drain water supplied to the sink bowl 31. The sink 30 may further include a water pipe 33 installed adjacent to the sink bowl 31 to supply water to the sink bowl 31. A water tap 34 may be coupled to one end of the water pipe 33. Water supplied to the sink bowl 31 from the water tap 34 may be drained through the drain and a drain pipe (not shown) connected to the drain.

The system kitchen 1 may further include the dishwasher 100 installed in a built-in type in the system kitchen 1.

The dishwasher 100 may include a plurality of doors 120 and 130 for a user's convenience. Specifically, the dishwasher 100 may include a top door 120 for allowing top loading of dishes, and a front door 130 for allowing front loading of dishes. The top door 120 and the front door 130 may be rotatably installed. However, installation forms of the top door 120 and the front door 130 are not limited to the above-described examples, and may change variously. For example, the top door 120 and the front door 130 may be slidingly opened or closed. As another example, any one of the top door 120 and the front door 130 may be slidingly opened or closed, and the other one of the top door 120 and the front door 130 may be rotatably opened or closed. Hereinafter, a case in which the top door 120 and the front door 130 are rotatably installed will be described. The top door 120 may be rotatably mounted on a cover frame 150. The front door 130 may be rotatably installed on a tub 110.

On the front door 130, at least one of a detergent case 141 for supplying a detergent to an inside of the tub 110 and a rinse case 142 for supplying a rinse to the inside of the tub 110 may be provided.

On the front door 130, a display 131 for displaying an operation state of the dishwasher 100 may be provided. Specifically, the display 131 may be positioned in a upper portion of a front surface of the front door 130. The display 131 may be implemented as a touch screen structure to enable a user to input commands.

On the front door 130, a control panel 132 may be provided. For example, the control panel 132 may include a power button, etc. of the dishwasher 100. The control panel 132 may be positioned at one side of the display 131.

Preferably, on the front door 130, at least one of the display 131 and the control panel 132 may be provided.

The dishwasher 100 may further include the tub 110 forming a washing space thereinside. The tub 110 may include a front opening 111 that is opened or closed by the front door 130. Preferably, the front opening 111 may be larger than the opening 11 formed in the counter 10. The tub 110 may further include a top opening 112 (see FIG. 3) corresponding to the opening 11 formed in the counter 10. The cover frame 150 which will be described later may be positioned above the top opening 112, and as a result, the top opening 112 may be opened or closed by the top door 120.

The dishwasher 100 may further include the cover frame 150. The cover frame 150 may be installed in the opening 11. The top door 120 may be mounted on the cover frame 150. The cover frame 150 may be installed above the opening 11 such that a portion of the cover frame 150 is placed on the counter 10 around the opening 11. That is, the cover frame 150 may include a bent portion 156 formed in one end to be placed on the counter 10. The bent portion 156 of the cover frame 150 may be exposed to an outside. A width W1 of the cover frame 150 exposed to the outside may be larger than a width W2 of the opening 11 formed in the counter 10 (see FIG. 3). The width W1 of the cover frame 150 and the width W2 of the opening 11 may be measured in the front-rear direction X of the system kitchen 1. Accordingly, the cover frame 150 may be installed above the opening 11 in the state in which the bent portion 156 of the cover frame 150 is supported by the counter 10.

The dishwasher 100 may further include at least one basket 161 and 162 positioned inside the tub 110, wherein the at least one basket 161 and 162 may be taken out through the front opening 111. The at least one basket 161 and 162 is also referred to as a "front loading basket". For example, the dishwasher 100 may include an upper basket 161 positioned in an upper space of the tub 110 in the up-down direction Z of the dishwasher 100, and a lower basket 162 positioned below the upper basket 161 in the up-down direction Z of the dishwasher 100. The upper basket 161 may be adjacent to an additional basket 170 which will be described later.

The dishwasher 100 may further include the additional basket 170 that may be taken out of the dishwasher 100 through the opening 11. The additional basket 170 is also referred to as a "top loading basket". The additional basket 170 may be positioned above the at least one basket 161 and 162. Specifically, the additional basket 170 may be positioned above the upper basket 161. The additional basket 170 may be taken out only through the opening 11, and taking-out of the additional basket 170 through the front opening 111 may be limited by the cover frame 150.

The front door 130 of the dishwasher 100 may form an outer appearance of the system kitchen 1. Specifically, the front door 130 of the dishwasher 100 may form a front outer appearance of the system kitchen 1 together with the cabinet door 21.

An upper end of the front door 130 and an upper end of the cabinet door 21 may be positioned on a reference line R extending in the width direction Y of the system kitchen 1. The reference line R may be an imaginary line extending in the width direction Y of the system kitchen 1 to be parallel to the counter 10. As such, by designing the system kitchen 1 such that the top end of the front door 130 is in line with the top end of the cabinet door 21, the system kitchen 1 may have a unified, tidy appearance.

Preferably, a lower end of the front door 130 and a lower end of the cabinet door 21 may also be positioned on a reference line R' extending in the width direction Y of the system kitchen 1. The reference line R' may be an imaginary line extending in the width direction Y of the system kitchen 1 to be parallel to the counter 10. That is, the reference line R' may be parallel to the reference line R.

The top door 120 of the dishwasher 100 may form an outer appearance of the system kitchen 1. Specifically, the top door 120 of the dishwasher 100 may form an outer appearance of a top surface of the system kitchen 1, together with the counter 10. A level difference in the height direction Z of the system kitchen 1 between the top door 120 and the counter 10 may be not great. When the level difference in the height direction Z of the system kitchen 1 between the top door 120 and the counter 10 is great, that is, when the top door 120 excessively protrudes upward from the system kitchen 1, ease of use may deteriorate. For example, a user may bump into the top door 120 excessively protruding upward from the system kitchen 1.

FIG. 3 is a cross-sectional view of the system kitchen of FIG. 1, and FIG. 4 is an exploded perspective view of the dishwasher according to the first embodiment of the disclosure. In FIG. 4, the front door 130 is omitted.

As shown in FIGS. 3 and 4, the dishwasher 100 may include the tub 110 forming a washing space therein, and a sump 180 positioned below the tub 110 and storing water.

The at least one basket 161 and 162 may be positioned in the inside of the tub 110 to move back and forth in the front-rear direction X of the system kitchen 1. Specifically, the at least one basket 161 and 162 may be taken out or accommodated through the front opening 111 of the tub 110 by at least one rack 190 slidingly supporting the at least one basket 161 and 162.

An upper side of the at least one basket 161 and 162 may open to accommodate dishes therein. The at least one basket 161 and 162 may be formed by wires 163 arranged in a grid pattern so that dishes accommodated in the at least one basket 161 and 162 may be easily washed by water. In other words, the at least one basket 161 and 162 may be formed by a plurality of wires 163 crossing each other to accommodate dishes therein.

The dishwasher 100 may further include at least one spray device 210 and 220 to spray water. The at least one spray device 210 and 220 may include a first spray device 210 positioned between the upper basket 161 and the lower basket 162, and a second spray device 220 positioned below the lower basket 162.

The first spray device 210 and the second spray device 220 may rotate on a rotation shaft to spray water.

In the tub 110, a heater (not shown) for heating water and a heater installation groove (not shown) may be formed. The heater installation groove may be formed in a bottom of the tub 110, and the heater may be installed in the heat installation groove.

The sump 180 may be positioned at a center of the bottom of the tub 110 to collect and pump water. The sump 180 may include a washing pump 181 for pumping water at high pressure, and a pump motor 182 for driving the washing pump 181.

The washing pump 181 may pump water to the first spray device 210 through a first supply pipe 260. Also, the washing pump 181 may pump water to the second spray device 220 through a second supply pipe 270.

The sump 180 may include a turbidity sensor (not shown) for detecting a contamination level of water. A controller (not shown) of the dishwasher 100 may use the turbidity sensor (not shown) to detect a contamination level of water, and control the number of times by which a washing operation or a rinsing operation is performed. That is, when a contamination level is high, the controller may increase the number of times by which a washing or rinsing operation is performed, and when a contamination level is low, the controller may decrease the number of times by which a washing or rinsing operation is performed.

The dishwasher 100 may further include the cover frame 150 installed in the opening 11 of the counter 10. The cover frame 150 may be installed in the opening 11 in such a way to be spaced from the tub 110 in the height direction Z of the system kitchen 1. In other words, the cover frame 150 may be installed in the opening 11 in such a way not to overlap with the tub 110 in the height direction Z of the system kitchen 1.

The cover frame 150 may include a cover frame body 158, and the bent portion 156 bent from the cover frame body 158 to be supported on the counter 10. The bent portion 156 may be formed in an upper end portion of the cover frame body 158 and bent toward the outside of the dishwasher 100.

The cover frame body 158 may include a resting portion 151 on which the top door 120 is rested. Specifically, on the resting portion 151 of the cover frame body 158, a top door hinge 290 including a hinge shaft 291 may be mounted. The top door 120 may be coupled to the top door hinge 290 to be rotatable on the hinge shaft 291. The hinge shaft 291 of the upper door hinge 290 may extend in the width direction Y of the system kitchen 1.

The cover frame body 158 may further include a first wall 152 (see FIG. 6) extending in the height direction Z of the system kitchen 1 from the resting portion 151 (see FIG. 6). Specifically, the first wall 152 may extend in the height direction Z of the system kitchen 1 toward a up direction of the system kitchen 1 from an outer end portion of the resting portion 151. The resting portion 151 may face a bottom of the top door 120, and the first wall 152 may face side surfaces of the top door 120. In another aspect, the resting portion 151 and the first wall 152 may define a top door accommodating space to receive the top door 120.

The cover frame body 158 may further include a second wall 153 extending in the height direction Z of the system kitchen 1 from the resting portion 151. Specifically, the second wall 153 may extend in the height direction Z of the system kitchen 1 toward a down direction of the system kitchen 1 from an inner end portion of the resting portion 151.

The second wall 153 may further extend in the height direction Z of the system kitchen 1 than the first wall 152. That is, the second wall 153 may have a higher height in the height direction Z of the system kitchen 1 than the first wall 152.

A space defined by the first wall 152 may have a wider width in the width direction Y of the system kitchen 1 than a space defined by the second wall 153.

The dishwasher 100 may further include a cover frame sealing member 350. The cover frame sealing member 350 may be positioned between the cover frame 150 and the counter 10. In other words, the cover frame sealing member 350 may be coupled to at least one of the cover frame 150 and the counter 10. The cover frame sealing member 350 may complement sealing between the cover frame 150 and the counter 10 to prevent outside fluid from entering the inside of the dishwasher 100 through a gap between the cover frame 150 and the counter 10 or to prevent water stored inside the tub 110 from leaking out of the dishwasher 100 through the gap between the cover frame 150 and the counter 10. The cover frame sealing member 350 may be formed of an elastic material. For example, the cover frame sealing member 350 may be formed of rubber or the like.

The dishwasher 100 may further include a top door sealing member 300. The top door sealing member 300 may be coupled to the top door 120. The top door sealing member 300 may complement sealing between the cover frame 150 and the top door 120 to prevent water stored inside the tub 110 from leaking out of the top door 120. The top door sealing member 300 may be formed of an elastic material. For example, the top door sealing member 300 may be formed of rubber or the like.

The dishwasher 100 may further include a housing panel 800. The housing panel 800 may be positioned outside the tub 110. Specifically, the housing panel 800 may be coupled to both side walls of the tub 110, that is, a left side wall and a right side wall of the tub 110.

The dishwasher 100 may include a tub body 113, and a tub top 114 mounted on the tub body 113. The tub 110 may include the tub body 113 and the tub top 114. The tub top 114 may be coupled to a top end portion of the tub body 113. In the tub top 114, the top opening 112 corresponding to the opening 11 of the counter 10 may be formed.

The tub top 114 may be formed of a material that is different from that of the tub body 113. For example, the tub top 114 may be formed of polypropylene (PP), and the tub body 113 may be formed of stainless steel (STS).

In the tub top 114, a water collecting portion 115 may be formed. The water collecting portion 115 may be formed along a circumference of the tub top 114 to have a predetermined depth. The water collecting portion 115 may be formed in the tub top 114 to be located outside a connection member 310 which will be described later. When water flows along an outer side wall of the tub 110 without entering the inside of the tub 110 due to incomplete coupling, abrasion, etc. of the connection member 310, a unsanitary state may occur and furthermore, a dangerous situation such as a fire may be caused. The water collecting portion 115 may be formed in a top end of the tub body 113, that is, in the tub top 114 to collect water not entering the inside of the tub 110 and guide the water to the inside of the tub 110.

In the tub top 114, a panel fixing portion 116 may be provided. The housing panel 800 may be coupled to the tub 110 to face both the side walls of the tub 110. Specifically, the housing panel 800 may be coupled to the panel fixing portion 116 of the tub top 114 to face both the side walls of the tub body 113. The housing panel 800 may be fixed to the panel fixing portion 116 by a coupling member such as a screw.

The dishwasher 100 may further include the connection member 310. The connection member 310 may connect the cover frame 150 to the tub 110. Specifically, the connection member 310 may connect the cover frame 150 to the tub 110 to be stretchable in the height direction Z of the system kitchen 1. The connection member 310 may be formed of an elastic material. For example, the connection member 310 may be formed of rubber or the like. A top end portion of the connection member 310 may be coupled to the cover frame 150, and a lower end portion of the connection member 310 may be coupled to the tub 110. In other words, the top end portion of the connection member 310 may be coupled to the cover frame 150, and the lower end portion of the connection member 310 may be coupled to the tub top 114.

The dishwasher 100 may further include a front door sealing member 320. The front door sealing member 320 may be coupled to the front door 130. The front door sealing member 320 may complement sealing between the tub 110 and the front door 130 to prevent water stored inside the tub 110 from leaking out of the front door 130. The front door sealing member 320 may be formed of an elastic material. For example, the front door sealing member 320 may be formed of rubber or the like.

The top door 120 may include a communicator to control an operation of the dishwasher 1 depending on whether the top door 120 is opened or closed. For example, when the controller is positioned in a "lower module" which will be described later, the controller may be electrically connected to a sensor positioned in the top door 120 to determine whether the top door 120 is opened or closed. When the controller is positioned in the top door 120, the controller of the top door 120 may be electrically connected to the sensor positioned in the top door 120 to determine whether the top door 120 is opened or closed. Also, the controller of the top door 120 may be electrically connected to various electronic parts positioned in the lower module.

Hereinafter, a process in which the dishwasher 100 is installed in a built-in type in the system kitchen 1 will be described. For convenience of description, the cover frame 150 and the top door 120 among configurations of the dishwasher 100 will be referred to as a "upper module", and the remaining configurations of the dishwasher 100 except for the cover frame 150, the top door 120, and the connection member 310 will be referred to as a "lower module". First, the lower module may be installed in the cabinet 20 in the front-rear direction X of the system kitchen 1. Specifically, the lower module may be accommodated in the cabinet 20 of which the front side opens in the front-rear direction X of the system kitchen 1, and fixed to the cabinet 20. Thereafter, the top module may be installed in the counter 10. More specifically, the cover frame 150 may be installed in the opening 11 of the counter 10, and the top door 120 may be mounted on the cover frame 150. The upper module may be connected to the lower module by the connection member 310. Specifically, the cover frame 150 of the upper module may be connected to the tub 110 of the lower module by the connection member 310.

Hereinafter, the additional basket 170 will be described.

FIG. 5 is a perspective view of an additional basket of the dishwasher according to the first embodiment of the disclosure, and FIG. 6 is a perspective view of a cover frame of the dishwasher according to the first embodiment of the disclosure.

As shown in FIG. 5, a upper side of the additional basket 170 may open to accommodate dishes therein. The additional basket 170 may be formed by wires 171 arranged in a grid pattern so that dishes accommodated in the inside of the additional basket 170 may be easily washed by water. In other words, the additional basket 170 may be formed by a plurality of wires 171 crossing each other to accommodate dishes therein.

Specifically, the additional basket 170 may include a basket body 172. In the inside of the basket body 172, an accommodating space for accommodating dishes may be formed. An upper side of the basket body 172 may open to easily accommodate dishes. The basket body 172 may be formed by the wires 171 arranged in a grid pattern.

The additional basket 170 may include a handle 173. The handle 173 may be coupled to the basket body 172. The handle 173 may be in the shape of a closed loop. Also, corners of the handle 173 may be rounded. However, the shape of the handle 173 is not limited to the above-described example, and may change variously.

A height h1 of the handle 173 may be higher than a height h2 of the basket body 172. The height h1 of the handle 173 and the height h2 of the basket body 172 may be measured from a bottom of the additional basket 170, that is, a bottom of the basket body 172. Specifically, the height h1 of the handle 173 may be defined as a distance from the bottom of the basket body 172 to a top surface of the handle 173, and the height h2 of the basket body 172 may be defined as a distance from the bottom of the basket body 172 to a top of the basket body 172.

The additional basket 170 may further include a holding accessory 174 on which dishes are hung. The holding accessory 174 may be removably coupled to the basket body 172. The holding accessory 174 may include a holding portion 175 on which cutlery, a ladle, etc. are hung.

As shown in FIG. 6, the cover frame 150 may include a support 154. Specifically, on an inner wall of the cover frame 150, the support 154 may protrude toward the inside of the cover frame 150 such that the additional basket 170 is hung on the support 154. Specifically, the support 154 may protrude toward the inside of the cover frame 150 such that the additional basket 170 is hung on an inner surface of the second wall 153 of the cover frame 150. For example, a plurality of supports 154 may be respectively positioned on a left inner wall and a right inner wall of the cover frame 150.

The additional basket 170 may be rested on the cover frame 150. The additional basket 170 may be rested on the cover frame 150 when the wires 171 of the basket body 172 are hung on the supports 154. Specifically, when a first wire 171*a* which is the uppermost one of the wires 171 forming the right wall of the basket body 172 and a second wire 171*b* which is the uppermost one of the wires 171 forming the left wall of the basket body 172 are respectively supported on the supports 154 positioned on the right and left inner walls of the cover frame 150, the additional basket 170 may be rested on the cover frame 150.

On the cover frame 150, guides 155*a* and 155*b* for guiding a movement of the additional basket 170 may be positioned. Specifically, guides 155*a* and 155*b* protruding toward the inside of the cover frame 150 to guide a movement of the additional basket 170 in the up-down direction Z of the system kitchen 1 may be positioned on the inner walls of the cover frame 150. More specifically, the guides 155*a* and 155*b* protruding toward the inside of the cover frame 150 to guide a movement of the additional basket 170 in the up-down direction Z of the system kitchen 1 may be positioned on an inner surface of the second wall 153 of the cover frame 150. For example, the guides 155*a* and 155*b* may be positioned on a front inner wall and a rear inner wall of the cover frame 150. The supports 154 and the guides 155*a* and 155*b* may be positioned on the inner walls of the cover frame 150 and arranged alternately in a circumferential direction of the cover frame 150.

The guides 155*a* and 155*b* may include a first guide 155*a*, and a second guide 155*b* spaced a predetermined space from the first guide 155*a*. The additional basket 170 may move in the up-down direction Z of the system kitchen 1 in the state in which the handle 173 of the additional basket 170 is caught between the first guide 155*a* and the second guide 155*b*.

FIG. 7 is an enlarged view of a portion of FIG. 3.

As shown in FIG. 7, the dishwasher 100 may further include a first washing space 330 formed in the inside of the tub 110.

The dishwasher 100 may further include a second washing space 340 formed above the first washing space 330. The second washing space 340 may be formed between the top door 120 and the tub 110. The second washing space 340 may be defined by the cover frame 150. Specifically, the second washing space 340 may be defined by the second wall 153 of the cover frame 150. More specifically, the second washing space 340 may be defined by the top door 120, the second wall 153 of the cover frame 150, the connection member 310, and the tub 110.

The additional basket 170 may be taken out through the opening 11. In the additional basket 170, dishes D of which at least one portion is positioned in the first washing space 330 may be accommodated. That is, in the additional basket 170, dishes D of which at least one portion is positioned closer to the top door 120 than the handle 173 of the additional basket 170 may be accommodated. As such, because taking-out of the additional basket 170 in the front-rear direction X of the system kitchen 1 is limited by the cover frame 150 although large dishes D are accommodated in the additional basket 170, the dishes D accommodated in the additional basket 170 may be prevented from being damaged when the additional basket 170 is taken out.

The additional basket 170 may be positioned such that at least one portion of the additional basket 170 is accommodated in the inside of the at least one basket 161 and 162. Specifically, at least one portion of the additional basket 170 may be accommodated in the inside of the upper basket 161.

When at least one portion of the additional basket 170 is accommodated in the at least one basket 161 and 162, taking the at least one basket 161 and 162 out of the tub 110 may be limited. Specifically, when at least one portion of the additional basket 170 is accommodated in the upper basket 161, taking the upper basket 161 out of the tub 110 may be limited.

FIGS. 8A and 8B show a process in which the additional basket is taken out of the dishwasher according to the first embodiment of the disclosure. In FIGS. 8A and 8B, the top door 120 is omitted.

As shown in FIGS. 8A and 8B, the additional basket 170 may be taken out or accommodated through the opening 11. Specifically, taking-out of the additional basket 170 through the front opening 111 may be limited by the cover frame 150. Specifically, taking-out of the additional basket 170 through the front opening 111 may be limited by interference between the handle 173 and the cover frame 150. More specifically, taking-out of the additional basket 170 through the front opening 111 may be limited by interference between the handle 173 and the second wall 153 of the cover frame 150. That is, the cover frame 150 may function as a stopper for preventing the additional basket 170 from being taken out through the front opening 111.

A movement of the additional basket 170 may be guided by the guides 155*a* and 155*b*. The additional basket 170 may be taken out or accommodated through the opening 111 in the state in which the handle 173 of the additional basket 170 is inserted between the first guide 155*a* and the second guide 155*b*.

The additional basket 170 may be rested on the cover frame 150. Specifically, the additional basket 170 may be rested on the cover frame 150 in the state in which at least one portion of the additional basket 170 is accommodated in the upper basket 161. The additional basket 170 may be rested on the cover frame 150 when the wires of the additional basket 170 are supported on the support 154. Specifically, the additional basket 170 may be rested on the cover frame 150 when the first wire 171*a* and the second wire 171*b* of the additional basket 170 are hung on the supports 154 of the cover frame 150. FIGS. 9A and 9B show a process in which an additional basket is taken out of a dishwasher according to a second embodiment of the disclosure. Hereinafter, descriptions overlapping with those given above with reference to FIGS. 8A and 8B are omitted.

As shown in FIGS. 9A and 9B, an additional basket 170*a* may be rested on the at least one basket 161 and 162.

The additional basket 170*a* may include a coupling portion 177 detachably coupled to the at least one basket 161 and 162. That is, the additional basket 170*a* may include the coupling portion 177 detachably coupled to the upper basket 161. Preferably, the coupling portion 177 may be formed on a bottom of the additional basket 170*a*. In other words, the coupling portion 177 may be formed on the bottom of the additional basket 170*a* to be opposite to the bottom of the upper basket 161. The coupling portion 177 of the additional basket 170*a* may be detachably coupled to the bottom of the upper basket 161. Specifically, the coupling portion 177 of the additional basket 170*a* may be detachably coupled to at least one of the plurality of wires 163 defining the bottom of the upper basket 161. For example, the additional basket 170*a* may include a plurality of coupling portions 177, and the plurality of coupling portion 177 may be detachably coupled to at least one of the plurality of wires 163 defining the bottom of the upper basket 161.

A dishwasher may be equipped as it is in a kitchen without being installed in a built-in type in a system kitchen. This type of dishwasher is defined as a free standing type of dishwasher. Hereinafter, a free standing type of dishwasher will be described.

FIG. 10 shows a dishwasher according to a third embodiment of the disclosure. FIG. 11 is a cross-sectional view of the dishwasher according to the third embodiment of the disclosure. FIG. 12 is an exploded perspective view of the dishwasher according to the third embodiment of the disclosure. Hereinafter, descriptions overlapping with those about the built-in type of dishwasher are omitted. In FIG. 12, the front door 130 is omitted. Hereinafter, in FIGS. 10 to 12, the additional basket 170 is omitted.

As shown in FIGS. 10 to 12, a dishwasher 100*a* may include a housing 500 forming an outer appearance.

The dishwasher 100*a* may further include the tub 110 forming the washing space 330 therein. The tub 110 may be positioned inside the housing 500. The tub 110 may include the front opening 111 that is opened or closed by the front door 130. Preferably, the front opening 111 may be larger than an opening 410 formed by a cover frame 400. The tub 110 may further include a top opening 112 provided to correspond to the opening 410 formed by the cover frame 400.

The dishwasher 100*a* may further include the plurality of doors 120 and 130 for a user's convenience. Specifically, the dishwasher 100*a* may include the top door 120 for allowing top loading of dishes, and the front door 130 for allowing front loading of dishes. The top door 120 and the front door 130 may be rotatably installed. However, installation forms of the top door 120 and the front door 130 are not limited to the above-described examples, and may change variously. Hereinafter, a case in which the top door 120 and the front door 130 are rotatably installed will be described. The top door 120 may be rotatably mounted on the cover frame 400. The front door 130 may be rotatably installed on the tub 110.

On the front door 130, at least one of the detergent case 141 for supplying a detergent to the inside of the tub 110 and the rinse case 142 for supplying a rinse to the inside of the tub 110 may be provided.

On the top door 120, a handle 700 may be installed to enable a user to easily open or close the top door 120.

The dishwasher 100*a* may further include the cover frame 400. The cover frame 400 may be positioned on the tub 110. The top door 120 may be mounted on the cover frame 400.

The cover frame 400 may include the resting portion 151 on which the top door 120 is rested. Specifically, on the resting portion 151 of the cover frame 400, the top door hinge 290 including the hinge shaft 291 may be mounted. The top door 120 may be coupled to the top door hinge 290 to be rotatable on the hinge shaft 291. The hinge shaft 291 of the upper door hinge 290 may extend in the left-right direction Y of the dishwasher 100*a*.

The cover frame 400 may further include the first wall 152 extending in the up-down direction Z of the dishwasher 100*a* from the resting portion 151. Specifically, the first wall 152 may extend in the up-down direction Z of the dishwasher 100*a* toward the up direction of the dishwasher 100*a* from the outer end portion of the resting portion 151. The resting portion 151 may face the bottom of the top door 120, and the first wall 152 may face the side surfaces of the top door 120. In another aspect, the resting portion 151 and the first wall 152 may define a top door accommodating space to receive the top door 120.

The cover frame 400 may further include the second wall 153 extending in the up-down direction Z of the dishwasher 100*a* from the resting portion 151. Specifically, the second wall 153 may extend in the height direction Z of the dishwasher 100*a* toward the down direction of the dishwasher 100*a* from the inner end portion of the resting portion 151.

The first wall 152 may further extend in the up-down direction Z of the dishwasher 100*a* than the second wall 153. That is, the first wall 152 may have a higher height in the up-down direction Z of the dishwasher 100*a* than the second wall 153.

The space defined by the first wall 152 may have a wider width in the left-right direction Y of the dishwasher 100*a* than the space defined by the second wall 153.

The dishwasher 100*a* may further include the top door sealing member 300. The top door sealing member 300 may be coupled to the top door 120. The top door sealing member 300 may complement sealing between the cover frame 400 and the top door 120 to prevent water stored inside the tub 110 from leaking out of the top door 120. The top door sealing member 300 may be formed of an elastic material. For example, the top door sealing member 300 may be formed of rubber or the like.

The dishwasher 100*a* may further include a connection frame 600 positioned between the tub 110 and the cover frame 400. The connection frame 600 may be positioned between the cover frame 400 and the tub 110 in the up-down direction Z of the dishwasher 100*a* to connect the cover frame 400 to the tub 110.

The dishwasher 100*a* may further include the at least one basket 161 and 162 positioned inside the tub 110, wherein the at least one basket 161 and 162 may be taken out through the front opening 111. The at least one basket 161 and 162 is also referred to as a "front loading basket". For example, the dishwasher 100*a* may include the upper basket 161 positioned in an upper space of the tub 110 in the up-down direction Z of the dishwasher 100*a*, and the lower basket 162 positioned below the upper basket 161 in the up-down direction Z of the dishwasher 100. The upper basket 161 may be adjacent to the additional basket 170 which will be described later. Descriptions about the at least one basket 161 and 162 have been given above with reference to FIGS. 3 and 4, and therefore, overlapping descriptions are omitted.

The dishwasher 100*a* may further include the additional basket 170 that is taken out through the opening 410 of the cover frame 400. The additional basket 170 is also referred to as a "top loading basket". The additional basket 170 may be positioned above the at least one basket 161 and 162. Specifically, the additional basket 170 may be positioned above the upper basket 161. The additional basket 170 may be taken out only through the opening 410 of the cover frame 400, and taking-out of the additional basket 170 through the front opening 111 may be limited by the cover frame 400. Descriptions about the additional basket 170 have been given above with reference to FIGS. 3 to 5, and therefore, overlapping descriptions are omitted.

The dishwasher 100*a* may further include the front door sealing member 320. The front door sealing member 320 may be coupled to the front door 130. The front door sealing member 320 may complement sealing between the tub 110 and the front door 130 to prevent water stored inside the tub 110 from leaking out of the front door 130. The front door sealing member 320 may be formed of an elastic material. For example, the front door sealing member 320 may be formed of rubber or the like.

The front door 130 of the dishwasher 100 may form a front, outer appearance of the dishwasher 100*a*.

The top door 120 of the dishwasher 100 may form a top, outer appearance of the dishwasher 100*a*. Specifically, the top door 120 of the dishwasher 100*a* may form the top, outer appearance of the dishwasher 100*a*, together with the cover frame 400.

The additional basket 170 may be rested on the cover frame 400. A method in which the additional basket 170 is rested on the cover frame 400 has been described above with reference to FIGS. 1 to 8B, and therefore, overlapping descriptions are omitted.

The additional basket 170 may be rested on the at least one basket 161 and 162. The additional basket 170 may be detachably coupled to the at least one basket 161 and 162. Specifically, the additional basket 170 may be detachably coupled to the upper basket 161. A method in which the additional basket 170 is rested on the upper basket 161 has been described above with reference to FIGS. 9A and 9B, and therefore, overlapping descriptions are omitted.

Hereinafter, a case in which the additional basket 170 is rested on the cover frame 400 will be described as an example.

FIGS. 13A and 13B show a process in which the additional basket is taken out of the dishwasher according to the third embodiment of the disclosure. In FIGS. 13A and 13B, the top door 120 is omitted.

As shown in FIGS. 13A and 13B, the additional basket 170 may be taken out or accommodated through the opening 410 of the cover frame 400. Taking-out of the additional basket 170 through the front opening 111 may be limited by the cover frame 400. Specifically, taking-out of the additional basket 170 through the front opening 111 may be limited by interference between the handle 173 and the cover frame 400. More specifically, taking-out of the additional basket 170 through the front opening 111 may be limited by interference between the handle 173 and the second wall 153 of the cover frame 400. That is, the cover frame 400 may function as a stopper for preventing the additional basket 170 from being taken out through the front opening 111.

A movement of the additional basket 170 may be guided by the guides 155*a* and 155*b*. The additional basket 170 may be taken out or accommodated through the opening 410 of the cover frame 400 in the state in which the handle 173 of the additional basket 170 is inserted between the first guide 155*a* and the second guide 155*b*.

The additional basket 170 may be rested on the cover frame 400. Specifically, the additional basket 170 may be rested on the cover frame 400 in the state in which at least one portion of the additional basket 170 is accommodated in the upper basket 161. The additional basket 170 may be rested on the cover frame 150 when the wires of the additional basket 170 are supported on the support 154. Specifically, the additional basket 170 may be rested on the cover frame 400 when the first wire 171*a* and the second wire 171*b* of the additional basket 170 are hung on the supports 154 of the cover frame 400.

FIG. 14 shows a system kitchen where a dishwasher according to a fourth embodiment of the disclosure is installed in a built-in type. Hereinafter, descriptions overlapping with those given above with reference to FIGS. 1 and 2 are omitted.

As shown in FIG. 14, the cover frame 150 may include a frame opening 159 that opens in the up-down direction Z (see FIG. 16). A user may take dishes out upward from the tub 110 through the opening 11 of the counter 10, the frame opening 159, and the top opening 112 of the tub 110.

The top door 120 may include a first detergent supply device 900 for supplying a detergent to the inside of the tub 110. The detergent supplied from the first detergent supply device 900 may be used to wash dishes loaded in the upper basket 161 through the top door 120. Detailed descriptions about the first detergent supply device 900 will be given later.

The front door 130 may include a second detergent supply device 140 for supplying a detergent to the inside of the tub 110. The second detergent supply device 140 may include a second detergent case 141 for supplying a detergent, and a second rinse case 142 for supplying a rinse to the inside of the tub 110. The second detergent supply device 140 may be used to wash dishes loaded in the lower basket 162 and the upper basket 161 through the front door 130.

FIG. 15 is a cross-sectional view of the system kitchen of FIG. 14, FIG. 16 is an exploded perspective view of the dishwasher according to the fourth embodiment of the disclosure, and FIG. 17 is a perspective view of the cover frame of the dishwasher according to the fourth embodiment of the disclosure. In FIG. 16, the front door 130 is omitted.

As shown in FIGS. 15 to 17, a dishwasher 1000 may include the tub 110 forming the washing space 330 therein, and the sump 180 positioned below the tub 110 and storing water.

The at least one basket 161 and 162 may be positioned in the inside of the tub 110 to move back and forth in the front-rear direction X of the system kitchen 1. Specifically, the at least one basket 161 and 162 may be taken out or accommodated through the front opening 111 of the tub 110 by the at least one rack 190 slidingly supporting the at least one basket 161 and 162.

The upper side of the at least one basket 161 and 162 may open to accommodate dishes in the at least one basket 161 and 162. The at least one basket 161 and 162 may be formed by the wires 163 arranged in a grid pattern so that dishes accommodated in the at least one basket 161 and 162 may be easily washed by water. In other words, the at least one basket 161 and 162 may be formed by the plurality of wires 163 crossing each other to accommodate dishes therein.

The dishwasher 1000 may further include the at least one spray device 210 and 220 to spray water. The at least one spray device 210 and 220 may include the first spray device 210 positioned between the upper basket 161 and the lower basket 162, and the second spray device 220 positioned below the lower basket 162.

The first spray device 210 and the second spray device 220 may rotate on a rotation shaft to spray water.

In the tub 110, a heater (not shown) for heating water and a heater installation groove (not shown) may be formed. The heater installation groove may be formed in the bottom of the tub 110, and the heater may be installed in the heat installation groove.

The sump 180 may be positioned at the center of the bottom of the tub 110 to collect and pump water. The sump 180 may include the washing pump 181 for pumping water at high pressure, and the pump motor 182 for driving the washing pump 181.

The washing pump 181 may pump water to the first spray device 210 through the first supply pipe 260. Also, the washing pump 181 may pump water to the second spray device 220 located below through the second supply pipe 270.

The sump 180 may include a turbidity sensor (not shown) for detecting a contamination level of water. A controller 2000 of the dishwasher 1000 may use the turbidity sensor (not shown) to detect a contamination level of water, and control the number of times by which a washing operation or a rinsing operation is performed. That is, when a contamination level is high, the controller 2000 may increase the number of times by which a washing or rinsing operation is performed, and when a contamination level is low, the controller 2000 may decrease the number of times by which a washing or rinsing operation is performed.

The dishwasher 1000 may further include the cover frame 150 installed in the opening 11 of the counter 10. The cover frame 150 may be installed in the opening 11 in such a way to be spaced from the tub 110 in the height direction Z of the system kitchen 1. In other words, the cover frame 150 may be installed in the opening 11 in such a way not to overlap with the tub 110 in the height direction Z of the system kitchen 1.

The cover frame 150 may include the cover frame body 158, and the bent portion 156 bent from the cover frame body 158 to be supported on the counter 10. The bent portion 156 may be formed on the upper end portion of the cover frame body 158 and bent toward the outside of the dishwasher 1000.

The cover frame body 158 may include the resting portion 151 on which the top door 120 is rested. Specifically, on the resting portion 151 of the cover frame body 158, the top door hinge 290 including the hinge shaft 291 may be mounted. The top door 120 may be coupled to the top door hinge 290 to be rotatable on the hinge shaft 291. The hinge shaft 291 of the upper door hinge 290 may extend in the width direction Y of the system kitchen 1.

The cover frame body 158 may further include the first wall 152 extending in the height direction Z of the system kitchen 1 from the resting portion 151. Specifically, the first wall 152 may extend in the height direction Z of the system kitchen 1 toward the up direction of the system kitchen 1 1 from the outer end portion of the resting portion 151. The resting portion 151 may face the bottom of the top door 120, and the first wall 152 may face the side surfaces of the top door 120. In another aspect, the resting portion 151 and the first wall 152 may define a top door accommodating space to receive the top door 120.

The cover frame body 158 may further include the second wall 153 extending in the height direction Z of the system kitchen 1 from the resting portion 151. Specifically, the second wall 153 may extend in the height direction Z of the system kitchen 1 toward the down direction of the system kitchen 1 from the inner end portion of the resting portion 151.

The second wall 153 may further extend in the height direction Z of the system kitchen 1 than the first wall 152. That is, the second wall 153 may have a higher height in the height direction Z of the system kitchen 1 than the first wall 152.

The space defined by the first wall 152 may have a wider width in the width direction Y of the system kitchen 1 than the space defined by the second wall 153.

The dishwasher 1000 may further include the cover frame sealing member 350. The cover frame sealing member 350 may be positioned between the cover frame 150 and the counter 10. In other words, the cover frame sealing member 350 may be coupled to at least one of the cover frame 150 and the counter 10. The cover frame sealing member 350 may complement sealing between the cover frame 150 and the counter 10 to prevent outside fluid from entering the inside of the dishwasher 1000 through a gap between the cover frame 150 and the counter 10 or to prevent water stored inside the tub 110 from leaking out of the dishwasher 100 through the gap between the cover frame 150 and the counter 10. The cover frame sealing member 350 may be formed of an elastic material. For example, the cover frame sealing member 350 may be formed of rubber or the like.

The dishwasher 1000 may further include the top door sealing member 300. The top door sealing member 300 may be coupled to the top door 120. The top door sealing member 300 may complement sealing between the cover frame 150 and the top door 120 to prevent water stored inside the tub 110 from leaking out of the top door 120. The top door sealing member 300 may be formed of an elastic material. For example, the top door sealing member 300 may be formed of rubber or the like.

The dishwasher 1000 may further include the housing panel 800. The housing panel 800 may be positioned outside the tub 110. Specifically, the housing panel 800 may be coupled to both side walls of the tub 110, that is, the left side wall and the right side wall of the tub 110.

The dishwasher 1000 may include the tub body 113, and the tub top 114 mounted on the tub body 113. The tub top 114 may be coupled to the top end portion of the tub body 113. In the tub top 114, the top opening 112 corresponding to the opening 11 of the counter 10 may be formed. The tub top 114 may be formed of a material that is different from that of the tub body 113. For example, the tub top 114 may be formed of polypropylene (PP), and the tub body 113 may be formed of stainless steel (STS).

In the tub top 114, the water collecting portion 115 may be formed. The water collecting portion 115 may be formed along the circumference of the tub top 114 to have a predetermined depth. The water collecting portion 115 may be formed in the tub top 114 to be located outside the connection member 310 which will be described later. When water flows along the outer side walls of the tub 110 without entering the inside of the tub 110 due to incomplete coupling, abrasion, etc. of the connection member 310, an unsanitary state may occur and furthermore, a dangerous situation such as a fire may be caused. The water collecting portion 115 may be formed in the top end of the tub body 113, that is, in the tub top 114 to collect water not entering the inside of the tub 110 and guide the water to the inside of the tub 110.

In the tub top 114, the panel fixing portion 116 may be provided. The housing panel 800 may be coupled to the tub 110 to face both the side walls of the tub 110. Specifically, the housing panel 800 may be coupled to the panel fixing portion 116 of the tub top 114 to face both the side walls of the tub body 113. The housing panel 800 may be fixed to the panel fixing portion 116 by a coupling member such as a screw.

The dishwasher 1000 may further include the connection member 310. The connection member 310 may connect the cover frame 150 to the tub 110. Specifically, the connection member 310 may connect the cover frame 150 to the tub 110 to be stretchable in the height direction Z of the system kitchen 1. The connection member 310 may be formed of an elastic material. For example, the connection member 310 may be formed of rubber or the like. The top end portion of the connection member 310 may be coupled to the cover frame 150, and the lower end portion of the connection member 310 may be coupled to the tub 110. In other words, the top end portion of the connection member 310 may be coupled to the cover frame 150, and the lower end portion of the connection member 310 may be coupled to the tub top 114.

The dishwasher 1000 may further include the front door sealing member 320 (see FIG. 14). The front door sealing member 320 may be coupled to the front door 130. The front door sealing member 320 may complement sealing between the tub 110 and the front door 130 to prevent water stored inside the tub 110 from leaking out of the front door 130. The front door sealing member 320 may be formed of an elastic material. For example, the front door sealing member 320 may be formed of rubber or the like.

The top door 120 may include a communicator to control an operation of the dishwasher 1000 depending on whether the top door 120 is opened or closed. For example, the controller 2000 of the dishwasher 1000, which will be described later, may be electrically connected to the sensor positioned in the top door 120 to determine whether the top door 120 is opened or closed. The controller 2000 may be electrically connected to various electronic parts positioned in the lower module.

The cover frame 150 and the top door 120 among configurations of the dishwasher 1000 may be referred to as a "upper module", and the remaining configurations of the dishwasher 1000 except for the cover frame 150, the top door 120, and the connection member 310 may be referred to as a "lower module". In this case, the lower module may be first installed in the cabinet 20 in the front-rear direction X of the system kitchen 1 in order to install the dishwasher 1000 in a built-in type in the system kitchen 1. Specifically, the lower module may be accommodated in the cabinet 20 of which the front side opens in the front-rear direction X of the system kitchen 1, and fixed to the cabinet 20. Thereafter, the upper module may be installed in the counter 10. Specifically, the cover frame 150 may be installed in the opening 11 of the counter 10, and the top door 120 may be mounted on the cover frame 150. The upper module may be connected to the lower module by the connection member 310. Specifically, the cover frame 150 of the upper module may be connected to the tub 110 of the lower module by the connection member 310.

Hereinafter, the first detergent supply device 900 will be described.

FIG. 18A shows the detergent supply device when the top door of the dishwasher according to the fourth embodiment of the disclosure opens, and FIG. 18B shows a state in which the detergent case of the detergent supply device of FIG. 18A opens. FIG. 18C shows a state in which the rinse case of the detergent supply device of FIG. 18A opens. FIG. 19A is a brief side cross-sectional view of the detergent supply device when the top door of the dishwasher according to the fourth embodiment of the disclosure opens. FIG. 19B is a brief side cross-sectional view of the detergent supply device when the top door of the dishwasher according to the fourth embodiment of the disclosure is closed, and FIG. 19C is a brief side cross-sectional view of the detergent supply device of FIG. 19B when the detergent case opens.

As shown in FIGS. 18A to 18C, the first detergent supply device 900 may be positioned on the top door 120. Specifically, the first detergent supply device 900 may be positioned on the bottom (also referred to as an inner surface) 122 of the top door 120 to face the inside of the tub 110 when the top door 120 is closed (see FIG. 15).

The dishwasher 1000 according to an embodiment of the disclosure may enable the user to easily put dishes loaded in the sink 30 or on the counter 10 in the inside of the tub 110 or to easily take out dishes loaded in the inside of the tub 110 by opening the top door 120 rather than opening the front door 130, thereby increasing the user's convenience.

When a user easily loads dishes in the inside of the tub 110 through the top door 120 and opens a front door on which a detergent case is generally positioned to supply a detergent for washing the dishes, it is substantially difficult to increase the user's convenience through the top door 120 because the user needs to open the front door onerously to wash the dishes.

Accordingly, the dishwasher 1000 according to an embodiment of the disclosure may include the first detergent supply device 900 positioned on the top door 120 to enable a user to open only the top door 120 to easily load dishes and supply a detergent and a rinse to the dishwasher 1000.

The first detergent supply device 900 may include a first detergent case 910 for receiving a detergent from a user and supplying the detergent to the tub 110, and a first rinse case 920 for receiving a rinse from the user and supplying the rinse to the tub 110. Also, the first detergent supply device 900 may include an electronic component 950 on which an electronic part for driving a cover 940 which will be described later and driving the first detergent supply device 900 to spray the rinse from the first rinse case 920 is positioned.

In an inside space of the first detergent case 910, a detergent resting member 930 which enables a user to easily load a detergent in the first detergent case 910 and on which the detergent is rested may be positioned. The detergent resting member 930 may be rotatably coupled to the first detergent case 910, which will be described later.

In an inside space of the first rinse case 920, a rinse resting member 960 which enables a user to easily load a rinse in the first rinse case 920 and on which the rinse is rested may be positioned.

When the top door 120 opens, as shown in FIG. 18A, the first detergent case 910 and the first rinse case 920 may be maintained in a closed state. The first detergent case 910 may include an opening 911 that opens toward the tub 110 when the top door 120 is in a closed state, and the opening 911 of the first detergent case 910 may be opened and closed by the cover 940 that may slide.

As shown in FIG. 18B, a user may slide the cover 940 in one direction to open the first detergent case 910, and load a detergent in the detergent resting member 930. Also, the user may rotate a first rinse case door 921 for opening or closing the first rinse case 920 to open the first rinse case 920, and load a rinse in the rinse resting member 960.

The cover 940 may slide by a user, as described above, to open or close the first detergent case 910, or may be controlled to slide by the controller 2000 which will be described later during a washing operation of the dishwasher 1000 to automatically open or close the first detergent case 910.

The detergent resting member 930 may include a resting surface 933 on which a detergent is rested, a rotating portion 932 rotatably coupled to the first detergent case 910, and a detergent resting portion 931 which is a space formed by the resting surface 933 and the rotating portion 932 and in which the detergent is loaded. The rotating portion 932 may protrude in one direction from both ends of the resting surface 933 and be coupled to one side of the first detergent case 910. The rotating portion 932 may include a rotating protrusion (not shown in the drawings) and be inserted in a groove formed in the first detergent case 910 to correspond to the rotating protrusion so that the rotating portion 932 rotates with respect to the first detergent case 910, and accordingly, the detergent resting member 930 may rotate.

However, the rotating portion 932 is not limited to the embodiment of the disclosure. The rotating portion 932 may be rotatably coupled to the first detergent case 910 through various methods such as a hinge connection to the first detergent case 910.

Specifically, as shown in FIG. 19A, when the top door 120 opens, the detergent resting member 930 may rotate such that the detergent resting portion 931 is positioned at a first location A toward substantially the up direction.

When the detergent resting member 930 is positioned at the first location A, the user may easily supply a detergent to the detergent resting portion 931. The reason is because the resting surface 933 of the detergent resting portion 931 on which a detergent is rested is positioned toward the up direction so that the detergent may be stably loaded in the detergent resting portion 931.

The user may slide, as described above, the cover 940 to open the first detergent case 910, load a detergent in the detergent resting portion 931, and then again slide the cover 940 to again close the first detergent case 910, as shown in FIG. 19A.

Thereafter, as shown in FIG. 19B, when the top door 120 is closed, the detergent resting member 930 may rotate such that the detergent resting portion 931 is positioned at a second location B inclined with respect to substantially the up direction.

When the detergent resting member 930 is positioned at the second location B, the detergent loaded on the resting surface 933 may move to an inside space of the first detergent case 910 along the inclination of the resting surface 933. That is, when the detergent resting member 930 is positioned at the second location B, the detergent resting member 930 may supply the detergent to the first detergent case 910. Specifically, the detergent loaded on the resting surface 933 may be collected on an inner surface of the cover 940 along the inclination to be loaded in the inside of the first detergent case 910 until the cover 940 opens.

The detergent resting member 930 may be rotatably coupled to one side of the first detergent case 910 by the rotating portion 932 to rotate from the first location A to the second location B by a weight of the detergent resting member 930.

Thereafter, as shown in FIG. 19C, when the cover 940 slides by the controller 2000 during a washing operation of the dishwasher 1000 so that the first detergent case 910 opens, the detergent loaded in the first detergent case 910 may fall toward the tub 110 to be supplied to the tub 110. Through such a cycle, the user may open only the top door 120 to easily supply the detergent to the inside of the tub 110.

Hereinafter, the first detergent supply device 900 and the second detergent supply device 140 that are controlled by the controller 2000 will be described in detail.

FIG. 20 is a control block diagram of the detergent supply device of the dishwasher according to the fourth embodiment of the disclosure, and FIG. 21 is a control flow chart of the detergent supply device of the dishwasher according to the fourth embodiment of the disclosure.

As shown in FIG. 20, the dishwasher 1000 may include an inputter 2100 for receiving a user's input and transferring a signal for starting a washing operation of the dishwasher 1000 to the controller 200. The controller 2000 may receive a signal from the inputter 2100, and drive the washing pump 181 and the at least one spray device 210 and 220 to control a washing operation of the dishwasher 1000.

Also, the dishwasher 1000 may include a sensor portion 2200 including a door sensor for determining whether the front door 130 is opened or closed, the above-mentioned sensor positioned in the top door 120, etc. The sensor portion 2200 may transfer information about whether the front door 130 has opened before a signal is received from the inputter 2100, to the controller 2000.

The controller 2000 may control driving of the first detergent supply device 900 and the second detergent supply device 140 based on the information received from the inputter 2100 and the sensor portion 2200, as shown in FIG. 21.

When a process of controlling the first detergent supply device 900 and the second detergent supply device 140 by the controller 2000 starts during a washing operation of the dishwasher 1000, information about whether the front door 130 has opened before the washing operation may be received from the sensor portion 2200, in operation S100. Thereafter, the controller 2000 may determine whether the front door 130 has opened through the sensor portion 2200, in operation S200. When the controller 2000 determines that the front door 130 has opened before the washing operation, the controller 2000 may control the first detergent supply device 900 and the second detergent supply device 140 separately such that both the first detergent supply device 900 and the second detergent supply device 140 are driven, in operation S300. When the controller 2000 determines that the front door 130 has not opened before the washing operation, the controller 2000 may control the first detergent supply device 900 and the second detergent supply device 140 such that only the first detergent supply device 900 is driven, in operation S400. After the first detergent supply device 900 or both the first detergent supply device 900 and the second detergent supply device 140 are driven by the controller 2000 during the washing operation, the control of the first detergent supply device 900 and the second detergent supply device 140 by the controller 2000 during the washing operation may terminate.

A reason why the controller 2000 controls the first detergent supply device 900 and the second detergent supply device 140 is because, when a user loads dishes in the inside of the tub 110 only through the top door 120 without opening the front door 130, the user can wash the dishes by driving only the first detergent supply device 900 without driving the second detergent supply device 140 positioned on the front side of the tub 110.

That is, when the user loads dishes in the inside of the tub 110 by opening only the top door 120, the user may load a relatively small amount of dishes only in the upper basket 161 and then drive the dishwasher 1000. In this case, because no dishes are loaded in the lower basket 162, the second detergent supply device 140 may need not to be driven. Accordingly, through a control of the first detergent supply device 900 and the second detergent supply device 140 by the controller 2000, the first detergent supply device 900 and the second detergent supply device 140 may be efficiently driven.

FIG. 22 shows a system kitchen where a dishwasher according to a fifth embodiment of the disclosure is installed in a built-in type, FIG. 23 shows a state in which a first cover of a first detergent supply device of the dishwasher opens, in the system kitchen of FIG. 22, and FIG. 24 is a side cross-sectional view of the dishwasher of FIG. 22. A first detergent supply device 900' of a dishwasher 1000' according to the fifth embodiment of the disclosure will be described. Other configurations of the dishwasher 1000' except for the first detergent supply device 900' which will be described below are the same as the corresponding ones of the dishwasher 1000 according to the fourth embodiment of the disclosure, and therefore, overlapping descriptions are omitted.

As shown in FIGS. 22 to 24, the first detergent supply device 900' of the dishwasher 1000' may penetrate a top surface 123' and a lower surface 122' of a top door 120'. Portions of the first detergent supply device 900' corresponding to the top surface 123' and the lower surface 122' may open in the up-down direction.

Accordingly, the first detergent supply device 900' may include a first cover 970 for opening or closing the first detergent supply device 900' from the top surface 123' of the top door 120', and a second cover 980 for opening or closing the first detergent supply device 900' from the lower surface 122'.

As shown in FIG. 22, the first cover 970 may be positioned on the top surface 123' of the top door 120', and an outer surface 971 of the first cover 970 may be at a height corresponding to the top surface 123' of the top door 120' in the up-down direction. The outer surface 971 of the first cover 970 may be formed of the same material as the top surface 123' of the top door 120' to improve the beauty of the dishwasher 1000'.

The first cover 970 may be rotatable with respect to the top surface 123' of the top door 120', as shown in FIG. 23. One edge of the first cover 970 may be hinge-coupled to the top surface 123' of the top door 120' so that the first cover 970 may rotate on the edge to move upward. The first cover 970 may rotate upward by a push-up method, etc. through a configuration, such as a latch, a spring member, etc., which is not shown in the drawings.

The first cover 970 may rotate upward to open the first detergent case 910' and the second rinse case 920'. On an inner surface of the first cover 970, a detergent resting member 930' and a rinse resting member 960' may be positioned in correspondence to the first detergent case 910' and the first rinse case 920' to enable a user to open the first cover 970 to load a detergent and a rinse in the first detergent supply device 900'.

The detergent resting member 930' and the rinse resting member 960' of the first detergent supply device 900' may be rotatable, like the detergent resting member 930 of the first detergent supply device 900 according to the fourth embodiment of the disclosure.

That is, the detergent resting member 930' may include a detergent resting member 931' on which a detergent is rested, and a rotating portion 932' rotatably coupled to the first cover 970. The rotating portion 932' may protrude in one direction from both ends of the detergent resting portion 931' and be coupled to the inner surface 972 of the first cover 970.

When the first cover 970 opens, the detergent resting member 930' may rotate such that the detergent resting portion 931' is positioned at a first location A toward substantially the up direction, and accordingly, a user may easily supply a detergent to the detergent resting portion 931'. Because a resting surface 933' of the detergent resting portion 931' on which a detergent is rested is toward the up direction, a detergent may be stably loaded in the detergent resting portion 931'.

Thereafter, the user may press the first cover 970 to rotate the first cover 970, and accordingly, the first detergent case 910' may be closed by the first cover 970. When the first detergent case 910' is closed by the first cover 970, the detergent resting member 930' may rotate such that the detergent resting portion 931' is positioned at a second location B inclined with respect to substantially the up direction.

When the detergent resting member 930' is positioned at the second location B, as shown in FIG. 24, the detergent loaded on the resting surface 933' may move to an inside space of the first detergent case 910' along the inclination of the resting surface 933'. That is, when the detergent resting member 930' is positioned at the second location B, the detergent resting member 930' may supply the detergent to the first detergent case 910'. Specifically, the detergent loaded on the resting surface 933' may be collected on an inner surface of the second cover 980 along the inclination to be loaded in the inside of the first detergent case 910' until the second cover 980 opens.

Thereafter, when the second cover 980 slides by the controller 2000 during a washing operation of the dishwasher 1000' so that the first detergent case 910' opens, the detergent loaded in the first detergent case 910' may fall toward the tub 110 to be supplied to the tub 110. The rinse resting member 960' may also supply a rinse to the tub 110 through the same cycle, and therefore, overlapping descriptions thereof are omitted.

Through the cycle, the user may easily supply a detergent and a rinse to the tub 110 by opening only the first cover 970 without opening the top door 120'. That is, even when the user opens the top door 120', loads dishes in the upper basket 161 and then closes the top door 120' without supplying a detergent, the user may supply a detergent to the tub 110 by opening only the first cover 970 without having to again open the top door 120'.

FIG. 25 shows a state in which a first cover of a first detergent supply device of a dishwasher according to a sixth embodiment of the disclosure opens, in a system kitchen where the dishwasher is installed in a built-in type, and FIG. 26 is a side cross-sectional view of the dishwasher of FIG. 25. Hereinafter, other configurations of a dishwasher 1000" except for a first detergent supply device 900" are the same as those of the dishwasher 1000' according to the fifth embodiment of the disclosure, and therefore, overlapping descriptions are omitted.

The first detergent supply device 900" of the dishwasher 1000" may penetrate a top surface 123" and a lower surface 122" of a top door 120", as shown in FIGS. 25 and 26. Portions of the first detergent supply device 900" corresponding to the top surface 123" and the lower surface 122" may open in the up-down direction.

Accordingly, the first detergent supply device 900" may include a first cover 970" for opening or closing the first detergent supply device 900" from the top surface 123" of the top door 120", and a second cover 980" for opening or closing the first detergent supply device 900" from the lower surface 122".

The first cover 970" may be positioned on the top surface 123" of the top door 120" in such a way to be rotatable with respect to the top surface 123" of the top door 120". The first cover 970" may rotate to open or close a first detergent case 910" and a first rinse case 920".

However, the first cover 970" is not limited to the sixth embodiment of the disclosure, and the first cover 970" may slide in one direction to open or close the first detergent case 910" and the second rinse case 920".

As shown in FIG. 25, when the first detergent case 910" and the second detergent case 920" open upward, a user may load a detergent and a rinse directly in the first detergent case 910" and the second rinse case 920". That is, the detergent supply device 900" may include neither a detergent resting member nor a rinse resting member, and enable a user to directly load a detergent and a rinse in the first detergent case 910" and the first rinse case 920".

Because a user opens the first detergent case 910" and the first rinse case 920" through the first cover 970" without having to open the top door 120", the user may easily load a detergent and a rinse directly in the first detergent case 910" and the second detergent case 920".

Accordingly, as shown in FIG. 26, a detergent may be loaded in the first detergent case 910", and, when the second cover 980" slides by the controller 2000 to open the first detergent case 910" during a washing operation of the dishwasher 1000", the detergent loaded in the first detergent case 910" may fall toward the tub 110 to be supplied to the tub 110. The rinse resting member 960" may also supply a rinse to the tub 110 through the same cycle, and therefore, overlapping descriptions thereof are omitted.

A dishwasher may be equipped as it is in a kitchen without being installed in a built-in type in a system kitchen. This type of dishwasher is defined as a free standing type of dishwasher. Hereinafter, a free standing type of dishwasher will be described.

FIG. 27 is a perspective view of a dishwasher according to a seventh embodiment of the disclosure, and FIG. 28 is a cross-sectional view of the dishwasher of FIG. 27. FIG. 29 is an exploded perspective view of the dishwasher according to the seventh embodiment of the disclosure. Hereinafter, descriptions overlapping with those about a built-in type of dishwasher are omitted. Hereinafter, descriptions overlapping with those about the dishwasher 100*a* according to the third embodiment are omitted. "1000*a*" indicates the dishwasher according to the seventh embodiment of the disclosure.

As shown in FIGS. 27 to 29, the top door 120 may include the first detergent supply device 900 for supplying a detergent to the inside of the tub 110. The detergent supplied from the first detergent supply device 900 may be used to wash dishes loaded in the upper basket 161 through the top door 120.

Also, the front door 130 may include the second detergent supply device 140 for supplying a detergent to the inside of the tub 110. The second detergent supply device 140 may include the second detergent case 141 for supplying a detergent, and the second rinse case 142 for supplying a rinse to the inside of the tub 110. The second detergent supply device 140 may be used to wash dishes loaded in the lower basket 162 and the upper basket 161 through the front door 130.

Configurations of the first detergent supply device 900 and the second detergent supply device 140 and a driving method thereof are the same as those of the first detergent supply device 900 and the second detergent supply device 140 of the dishwasher 1000 according to the fourth embodiment of the disclosure, and therefore, overlapping descriptions are omitted.

While the present disclosure has been particularly described with reference to exemplary embodiments, it should be understood by those of skilled in the art that various changes in form and details may be made without departing from the spirit and scope of the present disclosure.

The invention claimed is:

1. A dishwasher configured to be installed in a built-in type system kitchen comprising a cabinet having an accommodating space and a counter positioned on the cabinet and including an opening, the dishwasher comprising:

a tub including a front opening;

a front door configured to open or close the front opening;

a top door configured to open or close the opening of the counter;

a cover frame configured to be installed in the opening of the counter, the top door being mounted on the cover frame, the cover frame having a wall surrounding the opening of the counter and a basket support extending into the opening of the counter from the wall;

a first basket positioned in the tub and configured to be taken out through the front opening of the tub;

a second basket positioned below the first basket in the tub to be taken out through the front opening of the tub; and an additional basket positioned above the first basket, configured to be supported by the basket support, and configured to be removed through the opening of the counter, wherein the first basket is configured to be taken out through the front opening of the tub after the additional basket is removed from the tub through the opening of the counter, wherein the additional basket includes a handle extending in a front-rear direction and wherein the wall is positioned above the front opening of the tub and configured to support a front portion and a rear portion of the handle.

2. The dishwasher of claim 1, wherein the additional basket is positioned above the first basket based on the additional basket being supported by the basket support.

3. The dishwasher of claim 1, wherein the basket support protrudes toward an inside of the cover frame such that the additional basket is hung on an inner wall of the cover frame.

4. The dishwasher of claim 1, wherein, when at least one portion of the additional basket is accommodated in the first basket, taking-out of the first basket from the tub is inhibited.

5. The dishwasher of claim 4, wherein the first basket includes a plurality of wires crossing each other to accommodate dishes, and the additional basket comprises a coupling portion detachably coupled to at least one of the plurality of wires.

6. The dishwasher of claim 1, wherein the cover frame includes a guide extending into the opening of the counter from the wall and wherein the guide includes a first guide and a second guide spaced apart from the first guide such that the handle of the additional basket is guided between the first guide and the second guide.

* * * * *